US008059997B2

(12) United States Patent
Otake et al.

(10) Patent No.: US 8,059,997 B2
(45) Date of Patent: Nov. 15, 2011

(54) DEVELOPER CARRYING MEMBER AND DEVELOPING APPARATUS

(75) Inventors: Satoshi Otake, Numazu (JP); Masayoshi Shimamura, Yokohama (JP); Yasutaka Akashi, Yokohama (JP); Takuma Matsuda, Suntou-gun (JP); Minoru Ito, Susono (JP); Kazuhito Wakabayashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/763,620

(22) Filed: Apr. 20, 2010

(65) Prior Publication Data

US 2010/0202801 A1 Aug. 12, 2010

Related U.S. Application Data

(63) Continuation of application No. PCT/JP2009/071363, filed on Dec. 16, 2009.

(30) Foreign Application Priority Data

Dec. 24, 2008 (JP) ..... 2008-327784

(51) Int. Cl.
*G03G 15/06* (2006.01)
*G03G 15/09* (2006.01)

(52) U.S. Cl. ..... 399/286; 399/279; 430/123.3; 492/59

(58) Field of Classification Search ..... 399/265, 399/267, 279, 284, 286; 430/123.3; 492/59
See application file for complete search history.

(56) References Cited

U.S. PATENT DOCUMENTS

| | | | | |
|---|---|---|---|---|
| 5,998,008 | A | 12/1999 | Shimamura et al. | |
| 6,035,172 | A * | 3/2000 | Mimura et al. | 399/286 |
| 6,154,625 | A * | 11/2000 | Saiki et al. | 430/123.3 |
| 6,287,246 | B1 * | 9/2001 | Yoshii et al. | 492/59 |
| 7,638,194 | B2 * | 12/2009 | Fukui et al. | 428/375 |
| 7,881,648 | B2 * | 2/2011 | Yoshida et al. | 399/286 |
| 2007/0238043 | A1 * | 10/2007 | Otake et al. | 430/122.5 |
| 2008/0247787 | A1 * | 10/2008 | Yoshida et al. | 399/286 |
| 2010/0028792 | A1 | 2/2010 | Otake et al. | 430/73 |

FOREIGN PATENT DOCUMENTS

| | | |
|---|---|---|
| JP | 08-030088 | 2/1996 |
| JP | 09-269648 | 10/1997 |
| JP | 2955310 B2 | 10/1999 |
| JP | 2001-312136 | 11/2001 |

(Continued)

OTHER PUBLICATIONS

International Search Report issued in the corresponding International Application No. Pct/JP2009/071363 dated Jan. 26, 2010—10 pages.

(Continued)

*Primary Examiner* — David Gray
*Assistant Examiner* — Fred Braun
(74) *Attorney, Agent, or Firm* — Fitzpatrick, Cella, Harper & Scinto

(57) ABSTRACT

A developer carrying member is disclosed which can stably provide toners with triboelectric charges even in various environments. The developer carrying member has a substrate and a resin layer as a surface layer formed on the surface of the substrate, and the resin layer contains a thermosetting resin as a binder resin, an acrylic resin having two units having specific structures, and conductive particles.

5 Claims, 3 Drawing Sheets

FOREIGN PATENT DOCUMENTS

| | | | | |
|---|---|---|---|---|
| JP | 2003-015403 | | | 1/2003 |
| JP | 3689531 | B2 | | 8/2005 |
| JP | 2006002051 | A | * | 1/2006 |
| JP | 2006078611 | A | * | 3/2006 |
| JP | 2006111676 | A | * | 4/2006 |
| JP | 2006-195442 | | | 7/2006 |
| JP | 2008233331 | A | * | 10/2008 |
| JP | 2010-008878 | | | 1/2010 |

OTHER PUBLICATIONS

Partial translation of JP 2010-008878 (Jan. 14, 2010).

PCT International Preliminary Report on Patentability and Written Opinion of the International Searching Authority, International Application No. PCT/JP2009/071363, Mailing Date Aug. 18, 2011.

* cited by examiner

DEVELOPER CARRYING MEMBER AND DEVELOPING APPARATUS

This application is a continuation of International Application No. PCT/JP2009/071363, filed Dec. 16, 2009, which claims the benefit of Japanese Patent Application No. 2008-327784, filed Dec. 24, 2008.

BACKGROUND OF THE INVENTION

1. Field of the Invention

This invention relates to a developer carrying member and a developing apparatus.

2. Description of the Related Art

In recent years, service environments of electrophotographic image forming apparatus are becoming more diverse than ever. Accordingly, it has become important to provide a developer carrying member that can stably provide toners with triboelectric charges over a long period of time even in various environments. Japanese Patent Application Laid-open No. 2001-312136 discloses a toner carrying member having a surface layer containing a quaternary-ammonium-containing copolymer. Then it discloses that such a toner carrying member can provide toners with superior negative chargeability, can prevent after-images from occurring and can remedy any fogging on electrophotographic images.

The present inventors have made studies on the above toner carrying member. As the result, they have realized that it has not still any sufficient performance in providing toners with triboelectric charges in an environment of high humidity. They have also realized that there is room for improvement also about charge-providing performance to a toner standing immediately after an electrophotographic image forming apparatus having been left to stand stopped over a long period of time is again operated. Further, it is preferable for the surface of a developer carrying member to have an appropriate conductivity so that the toner can be prevented from being charged in excess (undergoing charge-up) to come to stick to the surface of the developer carrying member because of mirror force. In order to obtain a developer carrying member which exhibits stable performance in various environments, it is important to make the developer carrying member have these properties in a well-balanced state.

SUMMARY OF THE INVENTION

Accordingly, the present invention is directed to provide a developer carrying member which can stably provide toners with triboelectric charges even in various environments. Further, the present invention is directed to provide an electrophotographic image forming apparatus, and a developing apparatus, that can stably form high-grade electrophotographic images even in various environments.

According to one aspect of the present invention, there is provided a developer carrying member comprising a substrate and a resin layer as a surface layer, wherein said resin layer comprises a thermosetting resin as a binder resin, an acrylic resin having units represented by the following formulas (1) and (2), and a conductive particle:

(1)

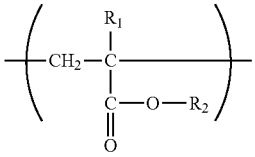

where, in the formula (1), $R_1$ represents a hydrogen atom or a methyl group, and $R_2$ represents an alkyl group having 8 to 18 carbon atoms; and (2)

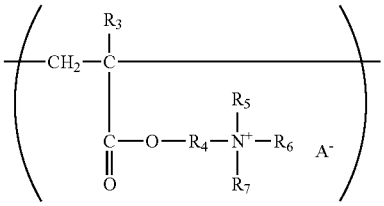

where, in the formula (2), $R_3$ represents a hydrogen atom or a methyl group; $R_4$ represents an alkylene group having 1 to 4 carbon atoms; one, two or three groups selected from the group consisting of $R_5$, $R_6$ and $R_7$ represents or respectively represent an alkyl group having 4 to 18 carbon atoms and the other group or groups represents or respectively represent an alkyl group having 1 to 3 carbon atoms; and $A^-$ represents an anion.

According to another aspect of the present invention, there is provided a developing apparatus comprising a developer having a toner particle contained in a developer container, and the afore-mentioned developer carrying member.

According to the present invention, the developer carrying member having the surface layer containing the acrylic resin having specific structures as described above can quickly stably provide the toner with uniform triboelectric charges. It can also keep the toner from being charged in excess (undergoing charge-up). Further, it makes its triboelectric charge-providing performance to toner not easily change even under conditions of high humidity.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Developer Carrying Member

The developer carrying member according to the present invention is described below.

Figure 1:
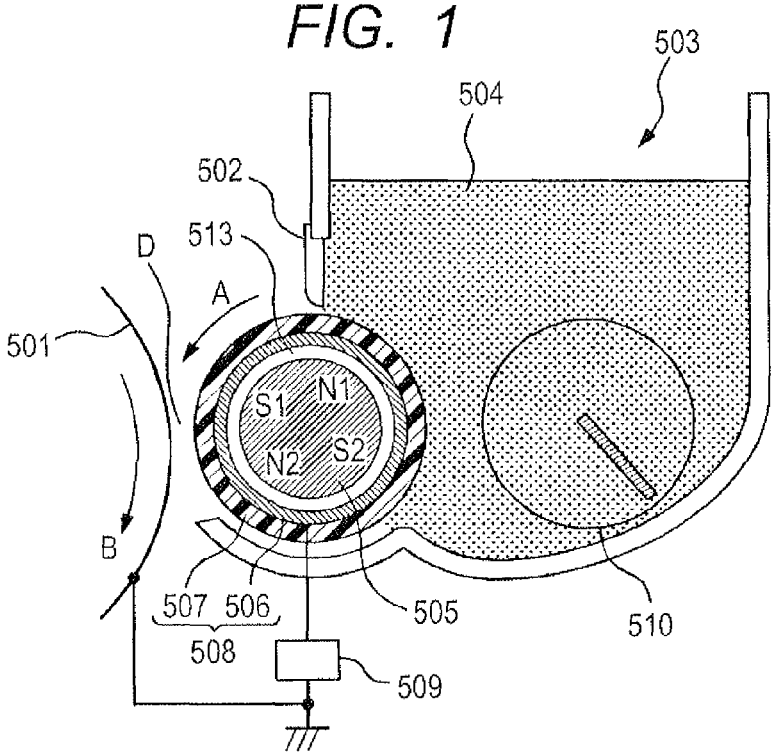
FIG. 1 is a diagrammatic view showing an example of the developing apparatus of the present invention, used in a developing method.

The developer carrying member has, as shown in FIG. 1, a substrate 506 and a resin layer 507 as a surface layer. The resin layer 507 contains a thermosetting resin as a binder resin, an acrylic resin and conductive fine particles.

Thermosetting Resin:

That the resin layer 507 contains a thermosetting resin as a binder resin makes the resin layer have good durability and environmental stability. The thermosetting resin may preferably include phenol resins, melamine resins, urea resins and benzoguanamine resins. Of these, phenol resins are particularly preferred from the viewpoint of wear resistance and environmental stability of the resin layer, and from the viewpoint of compatibility with the acrylic resin, which is detailed later. Of these thermosetting resins, a type that is soluble in lower alcohols such as methanol, ethanol, propanol and butanol is particularly preferred because of their good compatibility with the acrylic resin used in the present invention.

Acrylic Resin:

The acrylic resin contains at least an ester unit represented by the following formula (1) and a cationic unit represented by the following formula (2).

(1)

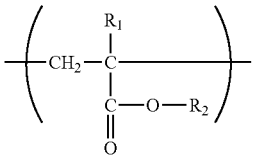

In the formula (1), $R_1$ represents a hydrogen atom or a methyl group, and $R_2$ represents an alkyl group having 8 to 18 carbon atoms. A form preferable as the ester unit represented by the formula (1) is that $R_1$ is a methyl group and $R_2$ is a long-chain alkyl group selected from a decyl group, an undecyl group, a dodecyl group, a tridecyl group and a tetradecyl group.

Then, inasmuch as the $R_2$ in the formula (1) is a long-chain alkyl group having 8 to 18 carbon atoms, the acrylic resin is improved in its compatibility with the thermosetting resin, and such an acrylic resin can uniformly be present in the binder resin with ease. This enables the developer carrying member according to the present invention to make the toner have more uniform triboelectric charges. In addition, pigments such as conductive particles can be improved in their dispersibility in the binder resin to make the developer carrying member less non-uniform in electrical resistance of its surface. This also acts effectively in making the toner have uniform triboelectric charges. If the $R_2$ is a lower alkyl group having 7 or less carbon atoms, the acrylic resin becomes higher in its polarity. That is, a greater difference in polarity may come between the acrylic resin and the thermosetting resin. Hence, the acrylic resin may come lower in its compatibility with the thermosetting resin, so that the acrylic resin may tend to be unevenly distributed in the resin layer. This acts disadvantageously in providing the toner with uniform triboelectric charges. This also makes the conductive particles tend to agglomerate in the resin layer, and hence acts disadvantageously in making the toner have uniform charge distribution. If on the other hand the $R_2$ is a long-chain alkyl group having 19 or more carbon atoms, the acrylic resin becomes more highly crystallizable to tend to cause phase separation between the thermosetting resin and the acrylic resin. In such a case, the acrylic resin tends to be so unevenly distributed in the resin layer as to be disadvantageous in providing the toner with uniform triboelectric charges.

(2)

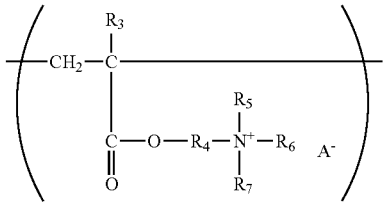

In the formula (2), $R_3$ represents a hydrogen atom or a methyl group, and $R_4$ represents an alkylene group having 1 to 4 carbon atoms. At least one substituent selected from the group consisting of $R_5$ to $R_7$ is an alkyl group having 4 to 18 carbon atoms and the other group or groups represents or each represent an alkyl group having 1 to 3 carbon atoms. $A^-$ represents an anion. The cationic unit represented by the formula (2) may more preferably be one having the following structure.

$R_3$: a methyl group;

$R_4$: a methylene group or an ethylene group;

$R_5$, $R_6$ and $R_7$ at least one selected from the group consisting of which: a long-chain alkyl group selected from an octyl group, a nonyl group, a decyl group, an undecyl group, a dodecyl group, a tridecyl group and a tetradecyl group; and $R_5$ to $R_7$ any group of which is/are not the above long-chain alkyl group: an alkyl group having 1 to 3 carbon atoms.

Introducing as at least one selected from $R_5$, $R_6$ and $R_7$ in the formula (2) the long-chain alkyl group having 4 to 18 carbon atoms brings an improvement in charge-providing performance to the toner. Also, such a quaternary ammonium base undergoes ionic dissociation in the resin layer to bring an improvement in conductivity of the resin layer. This enables the toner to be kept from being charged in excess, i.e., kept from a phenomenon of charge-up of the toner.

What is preferable as specific combination of the $R_5$ to $R_7$ is a cationic unit in which $R_5$ is any one selected from the group consisting of an octyl group, a nonyl group, a decyl group, an undecyl group, a dodecyl group, a tridecyl group and a tetradecyl group and $R_6$ and $R_7$ are each independently a methyl group, an ethyl group or a propyl group. This and the presence of the moiety of the formula (1) act together to make the resin layer much more improved and much more uniform in its performance of providing the toner with triboelectric charges. Also, inasmuch as at least one substituent selected from the group consisting of $R_5$ to $R_7$ is a long-chain alkyl group having 4 to 18 carbon atoms, the unit of the formula (2) can readily be present in a larger number on the surface side of the resin layer. Since the unit of the formula (2) is cationic, cationic units can consequently be in a large number on the resin layer surface to bring an improvement in negative charge-providing performance to the toner.

$A^-$ is an anion of those in halogens, inorganic acids such as hydrochloric acid, hydrobromic acid, sulfuric acid, phosphoric acid and nitric acid and organic acids such as carboxylic acids and sulfonic acids. It may preferably be an anion containing a sulfur atom or a halogen atom, and may much preferably be a halogen such as $Br^-$ or $Cl^-$ because of its good compatibility with the thermosetting resin.

The acrylic resin having the units represented by the formulas (1) and (2) may be produced by copolymerizing an acrylic monomer represented by the following formula (3) and an acrylic monomer having a quaternary ammonium base, represented by the following formula (4).

The former acrylic monomer may include a monomer represented by the following formula (3).

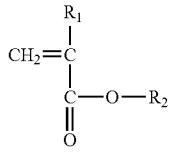

(3)

In the formula (3), $R_1$ represents a hydrogen atom or a methyl group, and $R_2$ represents an alkyl group having 8 to 18 carbon atoms. What is preferable as the monomer represented by the formula (3) is an acrylate in which $R_1$ is a hydrogen atom, or a methacrylate in which $R_1$ is a methyl group, and in which $R_2$ is a decyl group, an undecyl group, a dodecyl group, a tridecyl group or a tetradecyl group.

The latter acrylic monomer having a quaternary ammonium base may include a monomer represented by the following formula (4).

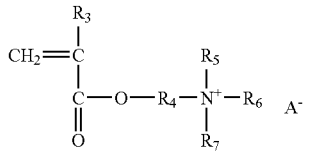

(4)

In the formula (4), $R_3$ represents a hydrogen atom or a methyl group. One, two or three groups selected from the group consisting of $R_5$, $R_6$ and $R_7$ is or are each an alkyl group having 4 to 18 carbon atoms and the other group or groups is or are each an alkyl group having 1 to 3 carbon atoms. $R_4$ is an alkylene group having 1 to 4 carbon atoms. Further, $A^-$ represents an anion.

What is preferable as the monomer represented by the formula (4) is one in which the one, two or three groups selected from the group consisting of $R_5$, $R_6$ and $R_7$ is or are each any of an octyl group, a nonyl group, a decyl group, an undecyl group, a dodecyl group, a tridecyl group and a tetradecyl group and $R_4$ is a methylene group or an ethylene group. In particular, preferred is one in which $R_5$ is any of an octyl group, a nonyl group, a decyl group, an undecyl group, a dodecyl group, a tridecyl group and a tetradecyl group and $R_6$ and $R_7$ are each an alkyl group selected from a methyl group, an ethyl group and a propyl group. $A^-$ is an anion of those in halogens, inorganic acids such as hydrochloric acid, hydrobromic acid, sulfuric acid, phosphoric acid and nitric acid and organic acids such as carboxylic acids and sulfonic acids. It may preferably be an anion containing a sulfur atom or a halogen atom, and may much preferably be a halogen such as $Br^-$ or $Cl^-$.

As a process for producing the acrylic resin, any known polymerization process may be used. The process therefor may include bulk polymerization, solution polymerization, emulsion polymerization and suspension polymerization. Solution polymerization is preferred in view of an advantage that the reaction can be controlled with ease. A solvent used in the solution polymerization may include lower alcohols such as methanol, ethanol, n-butanol and isopropyl alcohol. Besides, xylene, toluene and or like may also optionally be used in the form of a mixture. However, in view of improving the compatibility with the thermosetting resin used in the present invention, it is preferable to chiefly use a lower alcohol as the solvent. As the ratio of such a solvent to copolymerization monomer components, the solution polymerization may preferably be carried out using 30 parts by mass or more to 400 parts by mass or less of the copolymerization monomer components based on 100 parts by mass of the solvent.

The polymerization of such a monomer mixture may be carried out by, e.g., heating the monomer mixture in the presence of a polymerization initiator, in an atmosphere of an inert gas and at a temperature of from 50° C. or more to 100° C. or less. As examples of the polymerization initiator used for the polymerization, it may include the following: t-Butyl peroxy-2-ethylhexanoate, cumyl perpivarate, t-butyl peroxylaurate, benzoyl peroxide, lauroyl peroxide, octanoyl peroxide, di-t-butyl peroxide, t-butylcumyl peroxide, dicumyl peroxide, 2,2'-azobisisobutyronitrile, 2,2'-azobis-(2-methylbutyronitrile), 2,2'-azobis(2,4-dimethylvaleronitrile), 2,2'-azobis(4-methoxy-2,4-dimethylvaleronitrile), and dimethyl 2,2'-azobis(2-methyl propionate).

The polymerization initiator may be used alone or in combination of two or more types. Usually, the polymerization reaction is initiated with addition of the polymerization initiator to a monomer solution. However, in order to make any unreacted monomers less remain, part of the polymerization initiator may be added on the way of the polymerization. A method may also be employed in which the polymerization is accelerated by irradiation with ultraviolet rays or electron rays. These methods may also be combined. The polymerization initiator may preferably be used in an amount of from 0.05 part by mass or more to 30 parts by mass or less, and much preferably from 0.1 part by mass or more to 15 parts by mass or less, based on 100 parts by mass of the copolymerization monomer components. As temperature of the polymerization reaction, the reaction may preferably be carried out at a temperature of from 40° C. or more to 150° C. or less, which may be set in accordance with the solvent, polymerization initiator and copolymerization monomer components to be used.

As the monomer of the formula (4), a monomer may be used which has been formed by quaternizing a monomer represented by the following formula (5), by using a quaternizing agent.

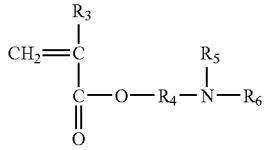

(5)

In the formula (5), $R_3$ represents a hydrogen atom or a methyl group, $R_5$ and $R_6$ each represent an alkyl group, and $R_4$ represents an alkylene group having 1 to 4 carbon atoms. A compound used as the quaternizing agent may include alkyl halides and organic acid compounds.

Examples of the alkyl halides are shown below: Butyl bromide, 2-ethylhexyl bromide, octyl bromide, lauryl bromide, stearyl bromide, butyl chloride, 2-ethylhexyl chloride, octyl chloride, lauryl chloride, stearyl chloride, etc. Examples of the organic acid compounds are shown below: Methyl p-toluenesulfonate, dimethyl sulfate, methyl hydroxynaphthalenesulfonate, etc.

The quaternizing agent may preferably be used in an amount of from 0.8 mole or more to 1.0 mole or less, per mole of the monomer represented by the formula (5). Such a monomer may be quaternized by, e.g., heating the monomer and the quaternizing agent to 60° C. or more to 90° C. or less in a solvent.

What has been obtained by copolymerizing the monomer of the formula (3) with the monomer of the formula (5) may also be further quaternized with the above quaternizing agent to obtain the desired quaternary ammonium base-containing acrylic copolymer. Besides, for example, the monomer represented by the formula (5) is quaternized with an alkyl halide such as methyl chloride and thereafter copolymerized with the monomer of the formula (3). The quaternary ammonium base-containing acrylic copolymer thus obtained may be treated with an acid such as p-toluenesulfonic acid or hydroxynaphthalenesulfonic acid to effect counter-ion exchange to obtain a quaternary ammonium base-containing acrylic copolymer made into the intended anionic species.

The respective units in the above acrylic resin may preferably be in such a compositional proportion that, where the number of the unit (1) and the number of the unit (2) in the acrylic resin are represented by a and b, respectively, the value of b/(a+b) is 0.5 or more to 0.9 or less. Inasmuch as the value of b/(a+b) is 0.5 or more, the acrylic resin is improved in its negative charge-providing performance and the effect of ionic conduction that is attributable to the quaternary ammonium base structure can be enhanced with ease. Hence, this brings an improvement in quick-charging performance to the toner. Inasmuch as the value of b/(a+b) is 0.9 or less, the respective units can uniformly be present in the binder resin. This makes the acrylic resin well compatible with the binder resin to make the former readily uniformly present in the resin layer. Further, this makes well dispersible the conductive particles that are to be present in the resin layer. Incidentally, in the present invention, where any units satisfying the make-up of each of the units (1) and (2) are contained in plural kind in the acrylic resin, the total number of the plural kind of unit components satisfying the structure (1) and the total number of the plural kind of unit components satisfying the structure (2) are represented by the a and the b, respectively.

The acrylic resin may contain a unit(s) other than the units (1) and (2). Such other unit(s) that may be contained in the acrylic resin may preferably be in a content of 30 mole % or less of the total number (mole) of units making up the acrylic resin. Inasmuch as the other unit(s) is/are in a content of 30 mole % or less, the effect due to the introduction of the units (1) and (2) can be obtained with ease.

The acrylic resin containing at least the units (1) and (2) may preferably be added in an amount of from 1 part by mass or more to 40 parts by mass or less, based on 100 parts by mass of the thermosetting resin as the binder resin. Its addition within this range can bring out the effect of charge control that is attributable to the addition, and also can make the acrylic resin uniformly present in the binder resin to enable the resin layer to retain its film strength.

In order to control resistance value of the resin layer, conductive particles including the following are incorporated in the resin layer. Examples of the conductive particles are shown below: Fine powder of metals (such as aluminum, copper, nickel and silver), particles of conductive metal oxides (such as antimony oxide, indium oxide, tin oxide, titanium oxide, zinc oxide, molybdenum oxide and potassium titanate), crystalline graphite, all kind of carbon fibers, conductive carbon black, etc. of these, conductive carbon black and crystalline graphite are preferred because of their superior dispersibility and superior electrical conductivity. The above conductive particles may be used in the form of a mixture of two or more types. The conductive particles may also preferably be added in an amount of from 20 parts by mass or more to 100 parts by mass or less, based on the mass of the binder resin. Their addition within this range enables the resin layer to have resistivity at the desired level without damaging its strength.

The resin layer at the surface of the developer carrying member of the present invention may preferably have a volume resistivity of from $10^{-1}$ Ω·cm or more to $10^{2}$ Ω·cm or less. Inasmuch as its value is within this range, the developer can be prevented from sticking to the surface of the developer carrying member because of charge-up, or from being poorly provided with triboelectric charges from the surface of the developer carrying member because of charge-up of the developer.

In the present invention, roughening particles for forming surface unevenness may also be added to the resin layer in order to make its surface roughness uniform and also to maintain its appropriate surface roughness, whereby much preferable results can be obtained. As the roughening particles for forming surface unevenness that may be used in the present invention, spherical particles are preferred. Inasmuch as they are spherical particles, the desired surface roughness can be achieved by their addition in a smaller quantity than any amorphous particles (particles lacking definite form), and also uneven surface with uniform surface profile can be achieved. Further, the resin layer may less change in surface roughness even where the surface of the resin layer has worn, and the toner layer on the developer carrying member can not easily change in thickness. Thus, the toner can uniformly electrostatically be charged, any sleeve ghost can well be prevented, any lines and non-uniformity can not easily occur, and also any sleeve staining with toner and toner melt-sticking can be made not to easily occur on the developer carrying member. Such effects can be brought out over a long period of time.

Substrate:

As the substrate, a member such as a cylindrical member, a columnar member or a beltlike member may be used. In the case of a developer carrying member used in a developing method in which it is in non-contact with a photosensitive drum, a cylindrical tube or solid rod of a rigid body like a metal may preferably be used. Such a substrate may be a non-magnetic metal or alloy such as aluminum, stainless steel or brass molded in a cylindrical shape and thereafter subjected to abrasion and grinding, which may preferably be used.

In the case of a developer carrying member used in a developing method in which it is brought into direct contact with a photosensitive drum, a columnar substrate may preferably be used which is made up of a mandrel made of a metal and provided on its peripheral surface a layer containing a rubber or elastomer such as urethane, EPDM or silicone. In a developing method making use of a magnetic developer, a substrate of a cylindrical shape may be used and a magnet roller may be disposed in the interior of the substrate in order to magnetically attract the developer to, and hold it on, the developer carrying member.

Resin Layer:

The resin layer may be formed by, e.g., a method in which components for the resin layer are dispersed and mixed in a solvent to make up a coating fluid and the substrate is coated therewith on its surface, followed by drying to harden or cure the wet coating formed. In dispersing and mixing the components to make up the coating fluid, a known dispersion mixer making use of beads may preferably be used, such as a sand mill, a paint shaker, Daino mill and a ball mill. As a coating method, a known method may preferably be used, such as dipping, spraying or roll coating.

In the present invention, the resin layer may preferably have, as its surface roughness, an arithmetic-mean roughness Ra (JIS B 0601-2001) of from 0.3 μm or more to 2.5 μm or less, and much preferably from 0.4 μm or more to 2.0 μm or less. Inasmuch as the resin layer surface has Ra within this range, the level of transport of the developer by the developer carrying member can be made stabler, and also the resin layer can have good wear resistance and resistance to contamination by developer. The resin layer may also preferably have a thickness of 25 μm or less, much preferably 20 μm or less, and still much preferably from 4 μm or more to 20 μm or less. This is preferable in order to achieve a uniform layer thickness, to which, however, the thickness is not particularly limited.

Developing Apparatus

A developing apparatus in which the developer carrying member according to the present invention has been incorporated is described next. FIG. 1 is a sectional view of the developing apparatus according to the present invention. In what is shown in FIG. 1, an electrostatic latent image bearing member, e.g., an electrophotographic photosensitive drum 501, holding thereon an electrostatic latent image formed by a known process is rotated in the direction of an arrow B. A developer carrying member 508 carries thereon a one-component developer 504 having a magnetic toner fed through a hopper 503 serving as a developer container holding therein the developer, and is rotated in the direction of an arrow A. Thus, the developer 504 is transported to a developing zone D where the developer carrying member 504 and the photosensitive drum 501 face each other. As shown in FIG. 1, inside the developer carrying member (developing sleeve) 504, a magnet roller 501 internally provided with a magnet is provided so that the developer 504 can magnetically be attracted to and held on the developer carrying member 508.

The developer carrying member 508 has a metal cylindrical tube (substrate) 506 and provided thereon a resin layer 507 as a surface layer. Inside the hopper 503, an agitating blade 510 for agitating the developer 504 is provided. Reference numeral 513 denotes a gap, which shows that the developer carrying member 508 and the magnet roller 505 stands non-contact. The developer 504 gains triboelectric charges which enable development of the electrostatic latent image formed on the photosensitive drum 501, as a result of the friction between magnetic toner particles one another which constitute the developer and between the developer and the resin layer 507 of the developer carrying member 508. In the example shown in FIG. 1, in order to control layer thickness of the developer 504 to be transported to the developing zone D, a magnetic control blade 502 made of a ferromagnetic metal, serving as a developer layer thickness control member, is used. The blade 502 vertically extends downwards from the hopper 503 in such a way that it faces on the developer carrying member 508 in a gap width of about 50 μm to 500 μm from the surface of the developer carrying member 508. The magnetic line of force exerted from a magnetic pole N1 of the magnet roller 505 is converged to the magnetic control blade 502 to thereby form on the developer carrying member 508 a thin layer of the developer 504. In the present invention, a non-magnetic blade may also be used in place of the magnetic control blade 502.

The thickness of the thin layer of the developer 504, thus formed on the developer carrying member 508, may preferably be much smaller than the minimum gap between the developer carrying member 508 and the photosensitive drum 501 in the developing zone D. It is especially effective to set the developer carrying member of the present invention in a developing apparatus of the type the electrostatic latent image is developed through such a developer thin layer, i.e., a non-contact type developing apparatus. The developer carrying member of the present invention may also be used in a developing apparatus of the type the thickness of the developer layer is not smaller than the minimum gap between the developer carrying member 508 and the photosensitive drum 501 in the developing zone D, i.e., a contact type developing apparatus. In the following description, to avoid complicacy of description, the non-contact type developing apparatus as described above is taken as an example.

In order to cause to fly the one-component developer 504 having a magnetic toner, carried on the developer carrying member 508, a development bias voltage is applied to the developer carrying member 508 through a development bias power source 509 serving as a bias applying means. When a DC voltage is used as this development bias voltage, a voltage having a value intermediate between the potential at electrostatic latent image areas (the region rendered visible upon attraction of the developer 504) and the potential at back ground areas may preferably be applied to the developer carrying member 508.

In the case of what is called regular development, where a toner is attracted to high-potential areas of an electrostatic latent image having high-potential areas and low-potential areas, a toner chargeable to a polarity reverse to the polarity of the electrostatic latent image is used. In the case of what is called reverse development, where a toner is attracted to low-potential areas of an electrostatic latent image having high-potential areas and low-potential areas, a toner chargeable to the same polarity as the polarity of the electrostatic latent image is used. What is herein meant by the high-potential areas or the low-potential areas is expressed by the absolute value. In either case of these, the developer 504 is electrostatically charged upon its friction with at least the developer carrying member 508.

Figure 2:
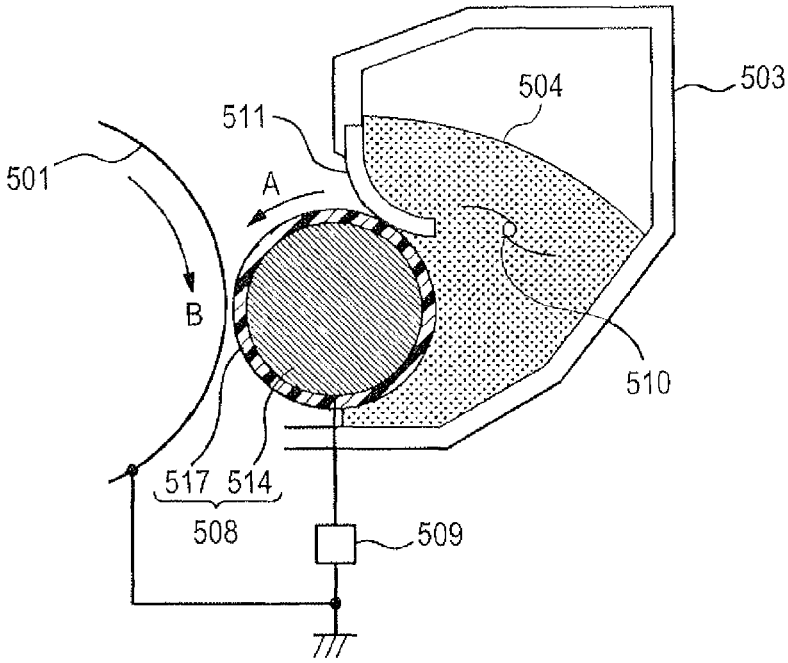
FIG. 2 is a diagrammatic view showing another example of the developing apparatus of the present invention, used in a developing method.
Figure 3:
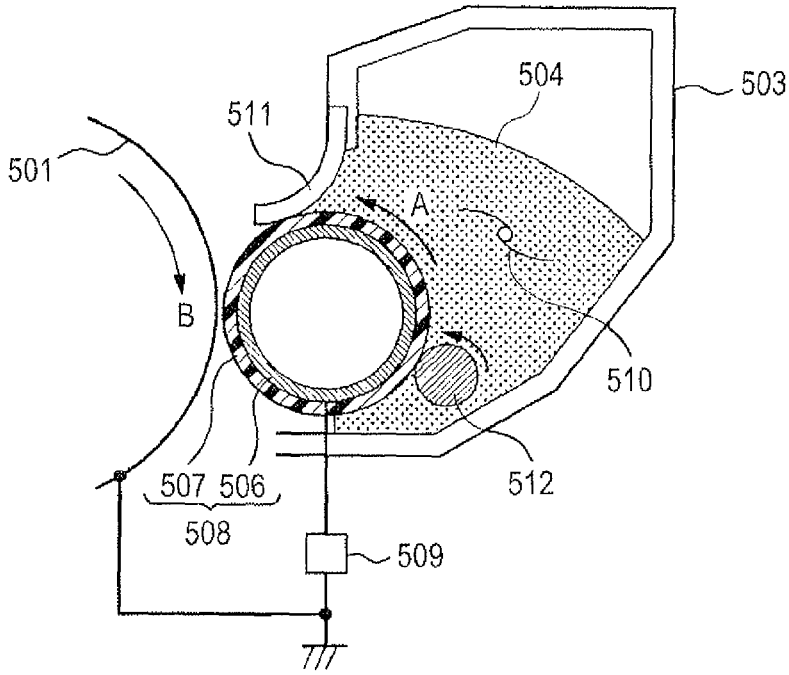
FIG. 3 is a diagrammatic view showing still another example of the developing apparatus of the present invention, used in a developing method.

FIG. 2 is a structural diagrammatic view showing another embodiment in the developing apparatus of the present invention, and FIG. 3 is a structural diagrammatic view showing still another embodiment in the developing apparatus of the present invention. In the developing assemblies shown in FIGS. 2 and 3, an elastic control blade 511 is used as the developer layer thickness control member which controls the layer thickness of the developer 504 held on the developer carrying member 508. This elastic control blade 511 is composed of a material having a rubber elasticity, such as urethane rubber or silicone rubber, or a material having a metal elasticity, such as bronze or stainless steel. In the developing apparatus shown in FIG. 2, this elastic control blade 511 is brought into pressure touch with the developer carrying member 508 in the direction reverse to its rotational direction. In the developing apparatus shown in FIG. 3, this elastic control blade 511 is brought into pressure touch with the developer carrying member 508 in the same direction as its rotational direction. In these developing assemblies, the developer layer thickness control member is elastically brought into pressure touch with the developer carrying member 508 through the developer layer to thereby form the thin layer of the developer on the developer carrying member 508. Hence, a much thinner developer layer than the case in which the magnetic control blade is used as illustrated in FIG. 1 can be formed on the developer carrying member 508. FIG. 2 presents a developing apparatus in a case in which a non-magnetic one-component developer is used as a toner 504, where, since the toner is non-magnetic, any magnet inside the developer carrying member 508 is not present, and a solid metallic rod 514 is used. The non-magnetic toner is triboelectrically charged upon its friction with the elastic control blade 511 or with a resin layer 517, and then transported to the surface of the developer carrying member 508.

In what is shown in FIG. 3, a developer stripping member 512 is provided in addition to the above. As the developer stripping member, used are a roller-shaped member made of resin, rubber or sponge and further a belt-shaped member or a brush-shaped member. In what is shown in FIG. 3, such a roller-shaped developer stripping member 512 is rotated in the direction reverse to the rotational direction of the developer carrying member 508. The developer stripping member 512 strips off the surface of the developer carrying member 508 any developer having not moved to the electrostatic latent image bearing member 501 and also makes uniform the charging of the developer. Incidentally, the electrostatic latent image bearing member is hereinafter also termed "photosensitive member" or "electrophotographic photosensitive member". Also, in the example shown in FIG. 3, a cylindrical tube 506 made of a metal is used as the substrate of the developer carrying member 508.

Figure 4:
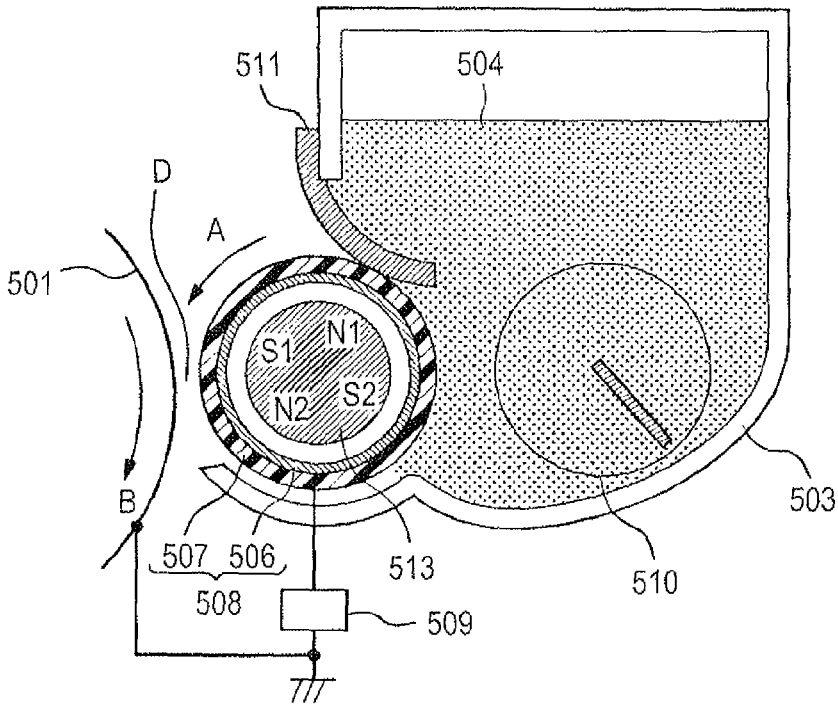
FIG. 4 is a diagrammatic view showing still another example of the developing apparatus of the present invention, used in a developing method.
Figure 5:
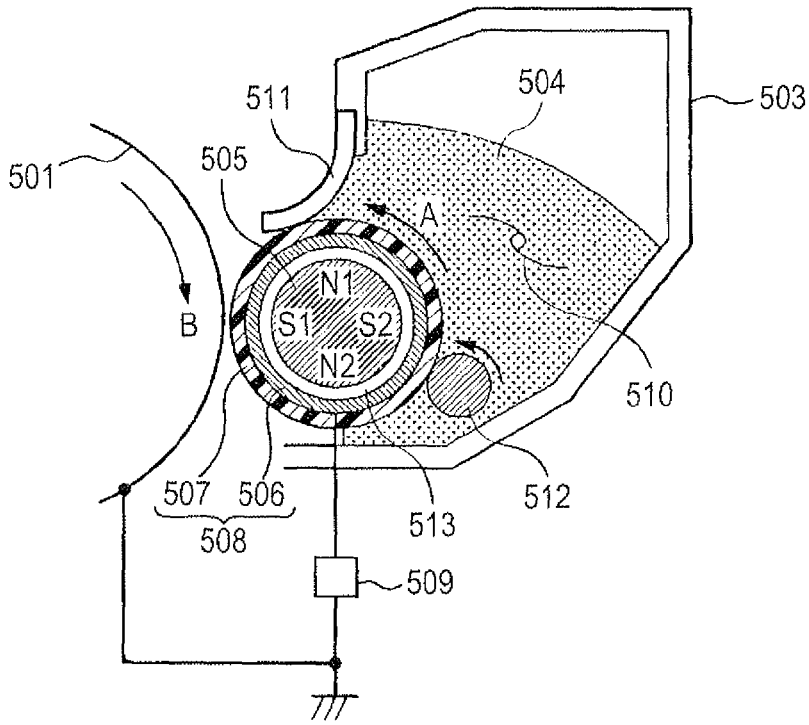
FIG. 5 is a diagrammatic view showing still another example of the developing apparatus of the present invention, used in a developing method.

In the developing assemblies shown in FIGS. 2 and 3, construction other than the foregoing is the same as the developing apparatus shown in FIG. 1, and like reference numerals denote basically the like members. FIGS. 4 and 5 are diagrammatic views each showing construction in which an elastic control member is provided in a developing apparatus making use of a magnetic toner. FIGS. 1 to 5 diagrammatically exemplify to the last the developing assemblies of the present invention. Needless to say, there may be various modes of the shape of the developer container (the hopper 503), the presence or absence of the agitating blade 510 and the arrangement of magnetic poles.

Developer

The developer (toner) is described below. Particles of the toner may be produced by a pulverization process or a polymerization process. Where they are produced by the pulverization process, any known method may be used. For example, components necessary for the toner, such as a binder resin, a magnetic material, a release agent, a charge control agent and optionally a colorant, and other additives, are thoroughly mixed by means of a mixer such as Henschel mixer or a ball mill. Thereafter, the mixture obtained is melt-kneaded by means of a heat kneading machine such as a heat roll, a kneader or an extruder, followed by cooling to solidify, then pulverization, thereafter classification, and optionally surface treatment to obtain toner particles. Either of the classification and the surface treatment may be first in order. In the step of classification, a multi-division classifier may preferably be used in order to improve production efficiency. The pulverization step may be carried out by using a known pulverizer such as a mechanical impact type or a jet type.

Such toner particles may be used after they have been subjected to sphering treatment or surface smoothing treatment by any method of various types, whereby it is observed that the magnetic material can more easily be enclosed in particles than in merely pulverized toner particles. This enables the developer to be improved in its transfer performance to keep, in virtue of its effect, the developer from being consumed in excess. As a method therefor, a method is available in which, using an apparatus having an agitating vane or blade and a liner or a casing, toner particles are made to pass through a micro-gap between the blade and the liner, where the surfaces of toner particles are made smooth, or toner particles are made spherical, by a mechanical force. Also, as a method for producing spherical toner particles directly, a method is available in which a mixture composed chiefly of monomers for forming the binder resin of toner particles is suspended in water and then polymerized to make it into toner particles. A commonly available method is a method in which a polymerizable monomer, a colorant, a polymerization initiator, and optionally a cross-linking agent, a charge control agent and other additives are uniformly dissolved or dispersed to prepare a monomer composition, and thereafter this monomer composition is dispersed by means of a suitable stirrer in a continuous phase, e.g., an aqueous medium, containing a dispersion stabilizer, to have a proper particle diameter, where polymerization reaction is further carried out to obtain toner particles having the desired particle diameter.

As toner particles having a high sphericity, it is preferable that, in toner particles having a circle-equivalent diameter of from 3 μm or more to 400 μm or less as measured with a flow type particle image analyzer, their average circularity is 0.970 or more. Inasmuch as the average circularity is 0.970 or more, the surfaces of individual toner particles can readily uniformly triboelectrically be charged to contribute to more improvement in charging uniformity. On the other hand, particles of a toner made to have a high sphericity tend to be charged in excess. However, the developer carrying member according to the present invention can well keep even such a toner from being charged in excess throughout its use at the initial stage up to image formation on a large number of sheets. This is considered due to the fact that the resin layer of the developer carrying member has a good conductivity because it contains the acrylic resin having the unit (2).

The toner may preferably have a weight average particle diameter of from 3 μm or more to 10 μm or less. Inasmuch as it has weight average particle diameter within this range of numerical values, transfer residual toner can be made less remain on the photosensitive member. Such a toner can also be kept from lowering in fluidity and agitation performance required as a powder, and hence the individual toner particles can readily uniformly be charged.

For the purpose of improving triboelectric charge characteristics, a charge control agent may be used in the developer (toner) by incorporating the former in toner particles (internal addition) or blending it with toner particles (external addition). As a positive charge control agent, it may include the following: Nigrosine, triaminotriphenylmethane dyes, and modified products thereof, modified with a fatty acid metal salt; quaternary ammonium salts such as tributylbenzylammonium 1-hydroxy-4-naphthosulfonate and tetrabutylammonium teterafluoroborate. Any of these may be used alone or in combination of two or more types. As a negative charge control agent, an organometallic compound or a chelate compound is effective. As examples thereof, it may include acetylacetonatoaluminum, acetylacetonatoiron(II) and chromium 3,5-di-tertiary-butylsalicylate. In particular, acetylacetone metal complexes, monoazo metal complexes, naphthoic acid, and salicylic acid type metal complexes or salts are preferred.

Where the developer (toner) is a magnetic developer (toner), a magnetic material is mixed. The magnetic material may include the following:

Iron oxide type metal oxides such as magnetite, maghemite and ferrite;

magnetic metals such as Fe, Co and Ni; and alloys of any of the above metals with one or two or more metals selected from Al, Co, Cu, Pb, Mg, Ni, Sn, Zn, Sb, Be, Bi, Cd, Ca, Mn, Se, Ti, W and V.

The above magnetic material may serve also as a colorant. As a colorant to be mixed in the developer (toner), any pigment or dye used conventionally in the present field may be used, which may be used under appropriate selection.

A release agent may preferably be mixed in the developer (toner). The release agent may include the following: Aliphatic hydrocarbon waxes such as low-molecular weight polyethylene, low-molecular weight polypropylene, microcrystalline wax and paraffin wax; and waxes composed chiefly of a fatty ester, such as carnauba wax, Fischer-Tropsch wax, sasol wax and montan wax.

In order to improve environmental stability, charging stability, developing performance, fluidity and storage stability and to improve cleaning performance, it is preferable to externally add an inorganic fine powder such as silica, titanium oxide or alumina powder to developer (toner) particles, i.e., to make it present on the surfaces of developer (toner) particles.

The inorganic fine powder may be added in such an amount of from 0.1% by mass to 5.0% by mass, and preferably from 0.5% by mass to 4.0% by mass, in the toner. Such an external additive may be used in combination of various types. An external additive(s) other than the inorganic fine powder may further be added. The external additive(s) other than the inorganic fine powder may include lubricants such as polytetrafluoroethylene, zinc stearate and polyvinylidene fluoride (in particular polyvinylidene fluoride), and also cerium oxide, strontium titanate and strontium silicate.

How to measure physical properties concerning the present invention is described next.

(1) Measurement of Arithmetic-Mean Roughness (Ra) of Developer Carrying Member Surface:

The arithmetic-mean roughness of the developer carrying member surface is measured according to JIS B0601 (2001) "Surface Roughness", using SURFCORDER SE-3500, manufactured by Kosaka Laboratory, Ltd., and under conditions of a cut-off of 0.8 mm, a measurement distance of 8 mm and a feed rate of 0.5 mm/s. Measured at the positions of 3 spots which are at the middle and coated resin layer both end portions of the developer carrying member in its lengthwise direction, 3 spots which are at the middle and both end portions of the same developer carrying member in its lengthwise direction at its position rotated by 90° from the first-measured position, and 3 spots which are at the middle and both end portions of the same developer carrying member in its lengthwise direction at its position further rotated by 90°, i.e., 9 spots in total. Then, their arithmetic-mean value is taken as the arithmetic-mean roughness (Ra) of the developer carrying member surface.

(2) Measurement of Volume Resistivity of Resin Layer of Developer Carrying Member:

A resin layer of 7 μm to 20 μm thick is formed on a polyethylene terephthalate (PET) sheet of 100 μm thick, and its volume resistivity is measured with a resistivity meter LORESTAR AP (manufactured by Mitsubishi Chemical Corporation), using a four-terminal probe. Measured in an environment of a temperature of 20 to 25° C. and a humidity of 50 to 60% RH.

(3) Volume Average Particle Diameter of Conductive Particles Added to Developer Carrying Member Resin Layer:

This is measured with a laser diffraction particle size distribution meter "Coulter LS-230 Particle Size Distribution Meter" (trade name; manufactured by Beckman Coulter, Inc.). In the measurement, a small-level module is used and, as a measuring solvent, isopropyl alcohol (IPA) is used. First, the inside of a measuring system of the measuring instrument is washed with the IPA for about 5 minutes, and background function is executed after the washing. Next, about 10 mg of a measuring sample is added to 50 ml of IPA. The solution in which the sample has been suspended is subjected to dispersion by means of an ultrasonic dispersion machine for about 2 minutes to obtain a sample fluid. Thereafter, the sample fluid is slowly added to the interior of the measuring system of the measuring instrument, and the sample concentration in the measuring system is so adjusted as to be 45% to 55% as PIDS (polarization intensity differential scattering) on the screen of the instrument. Thereafter, measurement is made, and volume average particle diameter calculated from volume distribution is determined.

(4) Measurement of Volume Resistivity of Conductive Fine Particles:

The particles are put in an aluminum ring of 40 mm in diameter, and then press-molded under 2,500 N. In a low-resistance region, the volume resistivity of the molded product obtained is measured with a resistivity meter LORESTAR AP (manufactured by Mitsubishi Chemical Corporation) using a four-terminal probe. In a medium/high-resistance region, it is measured with a resistivity meter HIRESTAR IP (manufactured by Mitsubishi Chemical Corporation) using a ring electrode probe. Measuring environment is set at 20 to 25° C. and 50 to 60% RH.

(5) Measurement of Particle Diameter of Toner:

Coulter counter Multisizer II (manufactured by Beckman Coulter, Inc.) is used as a measuring instrument. As an electrolytic solution, an aqueous about 1% NaCl solution is prepared using first-grade sodium chloride. As a method of measurement, 0.5 ml of an alkylbenzenesulfonate as a dispersant is added to 100 ml of the above aqueous electrolytic solution, and further 10 mg of a measuring sample is added. The electrolytic solution in which the sample has been suspended is subjected to dispersion for about 1 minute in an ultrasonic dispersion machine. The volume and number of the measuring sample are measure to calculate its volume distribution and number distribution, by means of the above measuring instrument and using a 100 μm aperture or 30 μm aperture as its aperture. From the results obtained, weight-base weight average particle diameter (D4) (the middle value of each channel is used as the representative value for each channel) determined from volume distribution is determined.

(6) Average Circularity of Toner Particles:

The average circularity referred to in the present invention is used as a simple method for expressing the shape of particles quantitatively. In the present invention, the shape of particles is measured with a flow type particle image analyzer FPIA-1000, manufactured by Toa Iyou Denshi K. K., and circularity (Ci) of each particle measured on a group of particles having a circle-equivalent diameter of 3 μm or more is individually determined according to the following expression.

Circularity (Ci)=(circumferential length of a circle with the same projected area as particle image)/(circumferential length of particle projected image)

As further shown in the following expression, the value obtained when the sum total of circularity of all particles measured is divided by the number of all particles is defined to be the average circularity.

$$\text{Average circularity}(C) = \sum_{i=1}^{m} Ci/m$$

The measuring instrument "FPIA-1000" used in the present invention employs, in calculating the circularity of each particle and thereafter calculating the average circularity and modal circularity, the following method. It is a method in which particles are divided into classes where the circularities of from 0.40 to 1.00 have been divided into 61 ranges at an interval of 0.010 in accordance with the resultant circularities, and the average circularity is calculated using the center values and frequencies of divided points. Between the values of the average circularity as calculated by this calculation method and the values of the average circularity as calculated by the above calculation equation which uses the circularity of each particle directly, there is only a very small accidental error, which is at a level that is substantially negligible. Accordingly, in the present invention, such a calculation method in which the concept of the calculation equation which uses the above circularity of each particle directly is utilized and is partly modified is used, for the reasons of handling data, e.g., making the calculation time short and making the operational equation for calculation simple. The circularity referred to in the present invention is an index showing the degree of surface unevenness of particles. It is indicated as 1.000 when the particles are perfectly spherical. The complicate the developer particle surface shape is, the smaller the value of circularity is.

As a specific measuring method, in 10 ml of water in which about 0.1 mg of a surface-active agent has been dissolved, about 5 mg of the developer is dispersed to prepare a dispersion. Then the dispersion is exposed to ultrasonic waves (20 kHz, 50 W) for 5 minutes. The dispersion is made to have a concentration of from 5,000 particles/μl to 20,000 particles/μl, where the measurement is made using the above analyzer to determine the average circularity of particles having a circle-equivalent diameter of 3 μm or more. The summary of measurement is described in a catalog of FPIA-1000 (an issue of June, 1995), published by Toa Iyou Denshi K. K., and in an operation manual of the measuring instrument, and is as follows:

The sample dispersion is passed through channels (extending along the flow direction) of a flat flow cell (thickness: about 200 μm). A strobe and a CCD (charge-coupled device) camera are so fitted as to position oppositely to each other with respect to the flow cell so as to form a light path that passes crosswise with respect to the thickness of the flow cell. During the flowing of the sample dispersion, the dispersion is irradiated with strobe light at intervals of 1/30 seconds in order to obtain an image of the particles flowing through the cell, so that a photograph of each particle is taken as a two-dimensional image having a certain range parallel to the flow cell. From the area of the two-dimensional image of each particle, the diameter of a circle having the same area is calculated as the circle-equivalent diameter. The circularity of each particle is calculated from the projected area of the two-dimensional image of each particle and from the circumferential length of the projected image according to the above equation for calculating the circularity.

The reason why in this measurement the circularity is measured only on the group of particles having a circle-equivalent diameter of 3 μm or more is that a group of particles of external additives that is present independently from toner particles are included in a large number in a group of particles having a circle-equivalent diameter of less than 3 μm, which may affect the measurement not to enable any accurate estimation of the circularity on the group of toner particles.

(7) How to Analyze Resin:

The structure of polymer of the acrylic resin is determined by analyzing with a pyrolytic GC/MS (gas chromatography/mass spectrometry) analyzer VOYAGER (trade name; manufactured by Thermo Electron Inc.) a sample obtained by scraping the resin layer of the developer carrying member. Analyzed under conditions of pyrolytic temperature: 600° C.; column: HP-1 (15 m×0.25 mm×0.25 μm); inlet: 300° C.; split: 20.0; injection rate: 1.2 ml/min.; heating: 50° C. (4 min.) to 300° C. (20° C./min.).

PRODUCTION EXAMPLE FOR ACRYLIC RESIN (AC-1) SOLUTION

The following materials were mixed in the interior of a four-necked separable flask fitted with a stirrer, a condenser, a thermometer, a nitrogen feed pipe and a dropping funnel.

| | |
|---|---|
| Dimethylaminoethyl methacrylate (monomer A-1) | 38.7 parts by mass |
| Lauryl bromide (quaternizing agent) | 61.3 parts by mass |
| Ethanol | 61.3 parts by mass |

The mixture obtained was heated to 70° C. and stirred for 5 hours to quaternize the monomer A-1 to obtain a quaternary ammonium base-containing monomer (2-methacryloyloxyethyl)lauryl dimethylammonium bromide. The reaction solution obtained was cooled, and thereafter 28.3 parts by mass of tridecyl methacrylate (monomer A-2) as a copolymerization component, 50 parts by mass of ethanol as a solvent and 1.0 part by mass of azobisisobutyronitrile (AIBN) as a polymerization initiator were loaded thereto. These were stirred until the system became uniform. With stirring continued, the reaction system was heated until its internal temperature came to 70° C., and a portion loaded into the dropping funnel was added over a period of 1 hour. After dropwise addition was completed, the reaction was further carried out for 5 hours in the state of reflux with the feeding of nitrogen, and, after 0.2 part by mass of AIBN was further added thereto, the reaction was carried out for 1 hour. Further, this solution was diluted with ethanol to obtain an acrylic resin, AC-1, having a solid content of 40%.

PRODUCTION EXAMPLES FOR ACRYLIC RESIN (AC-2 to 24) SOLUTIONS

Subsequently, acrylic resin solutions AC-2 to AC-24 were obtained in the same way as in AC-1 Production Example except that copolymerization components used were changed for components shown in Tables 1 and 2. Here, as to AC-10, an acrylic resin solution was formed and thereafter treated with an ion exchange resin to effect ion exchange of anions from bromide ions into p-toluenesulfonate ions.

TABLE 1

| | Quaternary ammonium base-containing unit | | | | | | | Ester unit 1 | | | Ester unit 2 | | |
|---|---|---|---|---|---|---|---|---|---|---|---|---|---|
| Co-polymer | A-1 | Amt. (pbm) | Quaternizing agent | R5; Carbon atoms | R6, R7; Carbon atoms | Anionic species | Amt. (pbm) | A-2 | Amt. (pbm) | R2; Carbon atoms | A-3 | Amt. (pbm) | R2; Carbon atoms |
| AC-1 | DM | 38.7 | Lauryl bromide | 12 | 1 | Br | 61.3 | TDMA | 28.3 | 13 | | | |
| AC-2 | DM | 32.1 | Stearyl bromide | 18 | 1 | Br | 68.0 | TDMA | 23.4 | 13 | | | |
| AC-3 | DM | 44.9 | Octyl bromide | 8 | 1 | Br | 55.1 | TDMA | 32.8 | 13 | | | |
| AC-4 | DM | 53.4 | Butyl bromide | 4 | 1 | Br | 46.6 | OTMA | 28.9 | 8 | | | |
| AC-5 | DM | 38.7 | Lauryl bromide | 12 | 1 | Br | 61.3 | OTMA | 48.7 | 8 | | | |

TABLE 1-continued

| | Quaternary ammonium base-containing unit | | | | | | | Ester unit 1 | | | Ester unit 2 | | |
|---|---|---|---|---|---|---|---|---|---|---|---|---|---|
| Co-polymer | A-1 | Amt. (pbm) | Quaternizing agent | R5; Carbon atoms | R6, R7; Carbon atoms | Anionic species | Amt. (pbm) | A-2 | Amt. (pbm) | R2; Carbon atoms | A-3 | Amt. (pbm) | R2; Carbon atoms |
| AC-6 | DM | 32.1 | Stearyl bromide | 18 | 1 | Br | 68.0 | OTMA | 17.3 | 8 | | | |
| AC-7 | DM | 63.0 | Butyl chloride | 4 | 1 | Cl | 37.1 | ODMA | 34.8 | 18 | DDMA | 17.5 | 12 |
| AC-8 | DM | 43.5 | Lauryl chloride | 12 | 1 | Cl | 56.6 | ODMA | 6.2 | 18 | DDMA | 3.1 | 12 |
| AC-9 | DM | 35.3 | Stearyl chloride | 18 | 1 | Cl | 64.8 | ODMA | 19.5 | 18 | DDMA | 9.8 | 12 |
| AC-10 | DM | 38.7 | Lauryl bromide | 12 | 1 | p-TSA | 61.3 | TDMA | 28.3 | 13 | | | |
| AC-11 | DM | 38.7 | Lauryl bromide | 12 | 1 | Br | 61.3 | 2EHMA | 20.9 | 8 | | | |
| AC-12 | DP | 46.1 | Lauryl bromide | 12 | 3 | Br | 53.9 | TDMA | 1.2 | 13 | | | |
| AC-13 | DE | 42.6 | Lauryl bromide | 12 | 2 | Br | 57.3 | TDMA | 114.6 | 13 | | | |
| AC-14 | DP | 60.9 | Iso-butyl bromide | 4 | 3 | Br | 39.1 | TDMA | 32.8 | 13 | | | |
| AC-15 | DE | 49.0 | 2-EH bromide | 8 | 2 | Br | 51.1 | TDMA | 70.9 | 13 | | | |
| AC-16 | DO | 51.5 | Stearyl bromide | 18 | 8 | Br | 48.5 | TDMA | 16.7 | 13 | | | |
| AC-17 | DM | 38.7 | Lauryl bromide | 12 | 1 | Br | 61.3 | MMA | 10.6 | 1 | | | |
| AC-18 | DM | 38.7 | Lauryl bromide | 12 | 1 | Br | 61.4 | DCMA | 16.6 | 22 | MMA | 6.3 | 1 |
| AC-19 | DE | 62.9 | Ethyl bromide | 2 | 2 | Br | 37.1 | TDMA | 39.1 | 13 | | | |
| AC-20 | DE | 32.3 | Docosyl bromide | 22 | 2 | Br | 67.8 | TDMA | 20.0 | 13 | | | |
| AC-21 | DM | 45.8 | Methyl p-TSA | 1 | 1 | p-TSA | 54.2 | MMA | 12.5 | 1 | | | |
| AC-22 | DM | 28.8 | Docosyl bromide | 22 | 1 | Br | 71.2 | MMA | 7.8 | 1 | | | |
| AC-23 | DE | 62.9 | Ethyl bromide | 2 | 2 | Br | 37.1 | DCMA | 23.0 | 22 | DDMA | 22.2 | 12 |
| AC-24 | DE | 32.3 | Docosyl bromide | 22 | 2 | Br | 67.8 | DCMA | 11.8 | 22 | BMA | 6.4 | 4 |

DM: Dimethylaminoethyl methacrylate
DE: Diethylaminoethyl methacrylate
DP: Dipropylaminoethyl methacrylate
DO: Dioctylaminoethyl methacrylate
2EH: 2-Ethylhexyl
p-TSA: p-Toluenesulfonic acid
MMA: Methyl methacrylate
MMA: Butyl methacrylate
2EHMA: 2-Ethylhexyl methacrylate
OTMA: Octyl methacrylate
DDMA: Dodecyl methacrylate
TDMA: Tridecyl methacrylate
ODMA: Octadecyl methacrylate
DCMA: Dococyl methacrylate

TABLE 2

| Acrylic Resin Unit Ratio | | | |
|---|---|---|---|
| | Unit ratio | | |
| Copolymer | Cation | Ester 1 | Ester 2 |
| AC-1 | 0.7 | 0.3 | |
| AC-2 | 0.7 | 0.3 | |
| AC-3 | 0.7 | 0.3 | |
| AC-4 | 0.7 | 0.3 | |
| AC-5 | 0.5 | 0.5 | |
| AC-6 | 0.7 | 0.3 | |
| AC-7 | 0.7 | 0.18 | 0.12 |
| AC-8 | 0.9 | 0.06 | 0.04 |
| AC-9 | 0.7 | 0.18 | 0.12 |
| AC-10 | 0.7 | 0.3 | |
| AC-11 | 0.7 | 0.3 | |
| AC-12 | 0.98 | 0.02 | |
| AC-13 | 0.35 | 0.65 | |
| AC-14 | 0.7 | 0.3 | |
| AC-15 | 0.5 | 0.5 | |
| AC-16 | 0.7 | 0.3 | |
| AC-17 | 0.7 | 0.3 | |
| AC-18 | 0.7 | 0.12 | 0.18 |
| AC-19 | 0.7 | 0.3 | |
| AC-20 | 0.7 | 0.3 | |
| AC-21 | 0.7 | 0.3 | |
| AC-22 | 0.7 | 0.3 | |
| AC-23 | 0.7 | 0.12 | 0.18 |
| AC-24 | 0.7 | 0.12 | 0.18 |

Conductive Particles:

D-1 Graphite particles (available from Nippon Graphite Industries, Ltd.; trade name: HOP; volume average particle diameter: 4.0 μm)

D-2 Conductive carbon black (available from Columbian Carbon Japan Limited; trade name: CONDUCTEX 975)

D-3 Conductive carbon black (available from Cabot Corp.; trade name: BLACK PEARL 2000)

Binder Resin:

R-1 Resol type phenolic resin (available from Dainippon Ink & Chemicals, Incorporated; trade name: J-325; solid content: 60%)

R-2 Butylated melamine resin (available from Dainippon Ink & Chemicals, Incorporated; trade name: L-109-65; solid content: 60%)

R-3 Butylated urea resin (available from Dainippon Ink & Chemicals, Incorporated; trade name: P-196-M; solid content: 60%)

R-4 Silicone resin (available from Momentive Performance Materials Japan Inc.; trade name: TSR127B; solid content: 50%)

R-5 Acrylic resin (available from Dainippon Ink & Chemicals, Incorporated; trade name: A-430-60; solid content: 60%)

DEVELOPER PRODUCTION EXAMPLE 1

A mixture of the following materials was prepared.

| | | |
|---|---|---|
| Styrene | 73.5 | parts by mass |
| n-Butyl acrylate | 19 | parts by mass |
| Monobutyl maleate | 7 | parts by mass |
| Divinylbenzene | 0.5 | part by mass |

-continued

| | |
|---|---|
| Benzoyl peroxide | 1 part by mass |
| t-Butyl peroxy-2-ethylhexanoate | 0.5 part by mass |

To this mixture, 180 parts by mass of water in which 0.8 part by mass of partially saponified polyvinyl alcohol was dissolved was added, followed by vigorous stirring to make up a suspending dispersion. This suspending dispersion was put into a reaction vessel into which 40 parts by mass of water was put and the inside atmosphere of which was displaced with nitrogen, to carry out suspension polymerization for 10 hours at a reaction temperature of 85° C. After the reaction was completed, the reaction product was filtered and then washed with water, followed by the steps of dehydration and drying to obtain a vinyl resin.

Next, a mixture of the following materials was prepared.

| | |
|---|---|
| Above vinyl resin | 100 parts by mass |
| Spherical magnetic material of 0.2 μm in average particle diameter | 90 parts by mass |
| Azo type iron complex compound (negative-charging charge control agent available from Hodogaya Chemical Co., Ltd.; trade name: T-77) | 1.5 parts by mass |
| Low-molecular weight ethylene-propylene copolymer | 5 parts by mass |

This mixture was melt-kneaded by means of a twin-screw extruder heated to 130° C. The kneaded product obtained was cooled and thereafter crushed by means of a hammer mill. The crushed product obtained was finely pulverized by means of a mechanical grinding machine Turbo Mill (manufactured by Turbo Kogyo Co., Ltd.), followed by heat sphering treatment. The finely pulverized product having been subjected to heat sphering treatment was treated by means of a multi-division classifier utilizing the Coanda effect (Elbow Jet Classifier, manufactured by Nittetsu Mining Co., Ltd.) to classify and remove ultra-fine powder and coarse powder simultaneously to obtain toner particles of 6.0 μm in weight average particle diameter (D4) and 0.963 in circularity. To 100 parts by mass of the toner particles thus obtained, 1.0 part by mass of hydrophobic colloidal silica was added, and these were mixed and dispersed by means of Henschel mixer to obtain a one-component magnetic developer, T-1.

DEVELOPER PRODUCTION EXAMPLE 2

The following monomers were loaded into a 5-liter autoclave together with an esterifying agent. A reflux condenser, a water separator, an $N_2$ gas feed pipe, a thermometer and a stirrer were attached to the autoclave, and, while $N_2$ gas was fed into the autoclave, condensation polymerization was carried out at 230° C. After the reaction was completed, the reaction product was taken out of the autoclave, and then cooled and pulverized to obtain a binder resin, C-1.

| | |
|---|---|
| Propoxidized bisphenol A (2.2 mole addition product) | 47.0 mole % |
| Terephthalic acid | 35.0 mole % |
| Trimellitic anhydride | 12.0 mole % |
| Isophthalic acid | 5.5 mole % |
| Phenol novolak EO addition product | 1.0 mole % |

The following monomers were also loaded into a 5-liter autoclave together with an esterifying agent. A reflux condenser, a water separator, an $N_2$ gas feed pipe, a thermometer and a stirrer were attached to the autoclave, and, while $N_2$ gas was fed into the autoclave, condensation polymerization was carried out at 230° C. After the reaction was completed, the reaction product was taken out of the autoclave, and then cooled and pulverized to obtain a binder resin, C-2.

| | |
|---|---|
| Propoxidized bisphenol A (2.2 mole addition product) | 47.0 mole % |
| Terephthalic acid | 50.0 mole % |
| Trimellitic anhydride | 3.0 mole % |

Next, the following materials were premixed by means of Henschel mixer, and thereafter the mixture obtained was melt-kneaded by means of a twin-screw extruder.

| | |
|---|---|
| Binder resin C-1 | 50 parts by mass |
| Binder resin C-2 | 50 parts by mass |
| Magnetic iron oxide particles (average particle diameter: 0.15 μm) | 90 parts by mass |
| Fischer-Tropsch wax (maximum endothermic peak temperature: 75° C.; Mn: 800, Mw: 1,100) | 2 parts by mass |
| Paraffin wax (maximum endothermic peak temperature: 105° C.; Mn: 1,500, Mw: 2,500) | 2 parts by mass |
| Azo type iron complex compound (negative-charging charge control agent available from Hodogaya Chemical Co., Ltd.; trade name: T-77) | 2 parts by mass |

At this point, retention time was so controlled that the resin kneaded had a temperature of 150° C. The kneaded product obtained was cooled and thereafter crushed by means of a hammer mill. The crushed product obtained was finely pulverized by means of a grinding machine making use of jet streams, and the finely pulverized powder was classified by means of a multi-division classifier utilizing the Coanda effect, to obtain negatively triboelectrically chargeable toner particles, E-1, of 6.9 μm in weight average particle diameter (D4). To 100 parts by mass of the magnetic toner particles thus obtained, 1.2 parts by mass of hydrophobic fine silica powder (BET specific surface area: 180 $m^2/g$) was externally added and mixed by means of Henschel mixer to obtain a developer, T-2, of 0.940 in circularity.

DEVELOPER PRODUCTION EXAMPLE 3

To 900 g of ion-exchanged water heated to 60° C., 3 parts by mass of tricalcium phosphate was added, followed by stirring at 10,000 rpm by means of a TK-type homomixer (manufactured by Tokushu Kika Kogyo Co., Ltd.) to prepare an aqueous medium. The following formulation was also introduced into a homomixer (manufactured by Nippon Seiki Co., Ltd.), and then heated to 60° C., followed by stirring at 9,000 rpm to effect dissolution and dispersion.

| | |
|---|---|
| Styrene | 155 parts by mass |
| n-Butyl acrylate | 45 parts by mass |
| C.I. Pigment Blue 15:3 | 17 parts by mass |

-continued

| | |
|---|---|
| Salicylic acid aluminum compound (trade name: BONTRON E-88, available from Orient Chemical Industries, Ltd.) | 2 parts by mass |
| Polyester resin (polycondensation product of propylene oxide modified bisphenol A and isophthalic acid; Tg: 65° C.; Mw: 10,000; Mn: 6,000) | 18 parts by mass |
| Stearyl stearate wax (DSC main peak: 60° C.) | 30 parts by mass |
| Divinylbenzene | 0.5 part by mass |

In this, 5 parts by mass of a polymerization initiator 2,2'-azobis(2,4-dimethylvaleronitrile) was dissolved to prepare a polymerizable monomer composition.

The polymerizable monomer composition was introduced into the above aqueous medium, followed by stirring at 60° C. in an atmosphere of nitrogen, using the TK-type homomixer at 8,000 rpm, to granulate the polymerizable monomer composition. Thereafter, the granulated product obtained was moved to a propeller stirrer and stirred, during which the temperature was raised to 70° C. over a period of 2 hours. Four hours after, the temperature was further raised to 80° C. at a rate of heating of 40° C./hr, where the reaction was carried out at 80° C. for 5 hours to produce polymer particles. After the polymerization was completed, a slurry containing the particles was cooled, which was then washed with water used in an amount 10 times that of the slurry, followed by filtration, drying, and thereafter classification to control particle diameter to obtain cyan toner base particles (weight average particle diameter: 6.6 μm; average circularity: 0.973). Into 100 parts by mass of the cyan toner base particles thus obtained, 1.0 part by mass of silica (R812, available from Aerosil Japan, Ltd.) was mixed by dry processing for 5 minutes by means of Henschel mixer (manufactured by Mitsui Mining & Smelting Co., Ltd.) to obtain a non-magnetic one-component developer, T-3, of 6.7 μm in weight average particle diameter and 0.974 in average circularity.

EXAMPLE 1

The following materials were mixed and put to dispersion for 2 hours by means of a sand mill making use of glass beads of 1 mm in diameter as media particles, to obtain a coating material intermediate, M-1.

| | |
|---|---|
| Binder resin (R-1) | 41.7 parts by mass as solid content |
| Conductive particles (D-1) | 44.4 parts by mass |
| Conductive particles (D-2) | 11.1 parts by mass |
| Methanol | 110.0 parts by mass |

Next, into the above coating material intermediate M-1, 58.3 parts by mass as solid content, of the binder resin R-1, 10.0 parts by mass as solid content, of the acrylic resin AC-1 and 11.1 parts by mass of surface unevenness-providing spherical particles (available from Nippon Carbon Co., Ltd.; trade name: ICB1020) were mixed. The mixture obtained was put to dispersion for 40 minutes by means of a sand mill making use of glass beads of 1.5 mm in diameter as media particles. Further, ethanol was added to adjust the solid content to a concentration of 35% to obtain a coating fluid, B1.

A ground-finished cylindrical tube made of aluminum, having an outer diameter of 16 mm and an arithmetic-mean roughness Ra of 0.2 μm, was rotated being stood on a rotating table, which tube was masked at its both end portions. This cylindrical tube was coated on its surface with the coating fluid B1 while a spray gun was descended at a constant speed. Through this step, a resin layer was formed on the tube. Here, as coating conditions, this coating was carried out in an environment of 30° C./35% RH and in the state the temperature of the coating fluid was controlled at 28° C. in a thermostatic chamber. Subsequently, the wet coating of the coating fluid was hardened by heating it at 150° C. for 30 minutes by means of a hot-air drying oven, to form the resin layer. Thus, a developer carrying member, S-1, of 1.19 μm in surface roughness Ra was produced. Formulation and physical properties of the resin layer of the developer carrying member (developing sleeve) S-1 are shown in Table 3.

The developer carrying member S-1 was set in as a developing roller of a cartridge for a laser beam printer (trade name: LASER JET P3005; manufactured by Hewlett-Packard Co.), and also as a toner the developer T-1 was filled in a toner container of the cartridge. This cartridge was mounted to the above laser beam printer. Using this laser beam printer, evaluations were made on the following items (1) to (6). The evaluations were each made in a low-temperature and low-humidity environment (L/L) of 15° C./10% RH, in a normal-temperature and normal-humidity environment (N/N) of 23° C./50% RH and in a high-temperature and high-humidity environment (H/H) of 30° C./85% RH.

Stated specifically, images were reproduced on 15,000 sheets in an intermittent mode of one sheet per 5 seconds and in a character pattern of 1% in print percentage, to make evaluations on the following items (1) to (6). The results of these evaluations are shown in Tables 4 to 6.

Toner charge quantity (Q/M) and toner transport quantity (M/S) on developer carrying member:

The following experiments were conducted in order to evaluate charge-providing ability of the developer carrying member.

The above laser beam printer was left for 24 hours in the L/L environment in the state it was disconnected. Thereafter, the printer was switched on, and solid black images were reproduced. The toner carried on the developer carrying member at this point was collected by suction through a metal cylindrical tube and a cylindrical filter, where toner charge quantity per unit mass Q/M (mC/kg) and toner transport quantity per unit area M/S (g/m$^2$) were calculated from the charge quantity Q accumulated in a capacitor through the metal cylindrical tube, the mass M of the toner collected and the area S over which the toner was sucked. The values found are taken as "Q/M(1)" and "M/S(1)", respectively.

Next, in the L/L environment, images were reproduced on 15,000 sheets in an intermittent mode of one sheet per 5 seconds and in a character pattern of 1% in print percentage, and subsequently solid black images were reproduced. About the toner carried on the developer carrying member at this point, the Q/M and the M/S were calculated in the same way as the above. The values found are taken as "Q/M(2)" and "M/S(2)", respectively. Further thereafter, the laser beam printer was left for 5 days in the L/L environment in the state it was disconnected. Then the printer was again switched on, and solid black images were reproduced. The Q/M and M/S of the toner carried on the developer carrying member at this point were calculated in the same way as the above. The values found are taken as "Q/M(3)" and "M/S(3)", respectively.

A series of the above evaluation was also made in the N/N environment and the H/H environment. "Q/M(1)" "Q/M(2)" and "Q/M(3)" in each environment and the rates of change (1) and (2) in "Q/M(2)" and "Q/M(3)" with respect to "Q/M(1)" are shown in Table 4. Similarly, "M/S(1)" "M/S(2)" and "M/S(3)" and the rates of change in "M/S(2)" and "M/S(3)" with respect to "M/S(1)" are shown in Table 4.

(2) Image Density:

Solid black images were reproduced both before images were reproduced in the above character pattern and after images having the above character pattern were reproduced on 15,000 sheets. Also, in order to evaluate a rise in triboelectric charging, images having the above character pattern were reproduced on 15,000 sheets and thereafter the laser beam printer was left for 5 days in the normal-temperature and normal humidity environment in the state it was disconnected. Thereafter, solid black images were reproduced. On each of the solid black images thus obtained on three sheets, image density was measured to make evaluation by the following criteria. In the measurement, a reflection densitometer (trade name: RD918; manufactured by Macbeth Co.) was used, where relative density with respect to the images on a white background portion of 0.00 in print density was measured.

A: 1.40 or more.

B: 1.35 or more to less than 1.40.

C: 1.30 or more to less than 1.35.

D: 1.25 or more to less than 1.30.

E: 1.00 or more to less than 1.25.

F: Less than 1.00.

(3) Ghosts:

Evaluation was made about ghosts on sleeve rotational periods, which tend to appear because of any excess charging of the toner or any non-uniform charge quantity distribution of the toner. A pattern was used in which, in an image pattern to be reproduced on the printer (an image chart in the case of a copying machine), a region corresponding to the developer carrying member one round at the top of the image pattern is held by solid-black square (20 mm each side) images arranged at regular intervals on a white background and the other region by a halftone image. Reproduced images were ranked by how ghosts of the square images appear on the halftone image.

A: No difference in tone is seen at all.

B: In such a degree that a slight difference in tone is ascertainable depending on view angles.

C: Ghosts are clearly visually seen.

D: Ghosts appear clearly as a difference in tone, in such a degree that the difference in tone is measurable with a reflection densitometer.

E: Ghosts appear clearly as a difference in tone, and differences in tone are ascertainable which correspond to two or more rounds of the developer carrying member.

(4) Blotches:

Halftone images and solid black images were reproduced. Here, toner images on the developer carrying member, and whether or not and to what extent blotches appeared, were visually observed to make evaluation by the following criteria. The blotches tend to come about when the toner stood charged in excess. Hence, whether or not and to what extent the blotches appear can be a standard of how the toner is charged in excess.

A: No blotch is seen at all both on halftone images and on the developer carrying member.

B: Blotches are slightly seen on the developer carrying member, but at such a level that they do not affect any images.

C: Blotches are slightly seen on some of halftone images.

D: A difference in tone is ascertainable on halftone images but not ascertainable on solid black images.

E: Clear differences in tone are ascertainable on halftone images and also on solid black images.

(5) Fog:

The reflectance of solid white images in proper images was measured and further the reflectance of a virgin transfer sheet was measured to make evaluation on fog, which tends to occur because of any excess charging or non-uniform charging of the toner. The value of (worst value of reflectance of solid white image)−(average value of reflectance of virgin transfer sheet) was found as fog density. The results of valuation are shown by the following criteria. Here, the reflectance was measured at 10 spots picked at random. The reflectance was measured with TC-6DS (manufactured by Tokyo Denshoku Co., Ltd.).

A: Less than 0.5%.

B: 0.5% or more to less than 1.0%.

C: 1.0% or more to less than 2.0%.

D: 2.0% or more to less than 3.0%.

E: 3.0% or more to less than 4.0%.

F: 4.0% or more.

(6) Image Quality:

The evaluation of image quality was made as evaluation on spots around minute fine-line images, concerned with the image quality of graphical images. Line reproducibility and toner spots around lines in the printing of one-dot line images, which more tends to cause spots around line images than when character lines cause spots around line images, were evaluated under magnification of images by 30 times with use of a magnifier.

A: Spots around line images little occur, showing a good line reproducibility.

B: Slight spots around line images are seen.

C: Spots around line images are seen, but not much affect line reproducibility.

D: Conspicuous spots around line images are seen, showing a poor line reproducibility.

EXAMPLES 2 TO 19 & COMPARATIVE EXAMPLES 1 TO 11

Developer carrying members S-2 to S-19 and S-29 to S-39 were produced in the same way as in Example 1 but under formulation shown in Table 3, and were evaluated in the same way. The results of evaluation are shown in Tables 4 to 6.

TABLE 3

Amt.: Amount (pbm)

| | Developer carrying | Acrylic resin | | Binder resin | | Conductive particles | | Conductive particles | | Unevenness particles | Ra | Volume resistivity |
|---|---|---|---|---|---|---|---|---|---|---|---|---|
| | member | Type | Amt. | Type | Amt. | Type | Amt. | Type | Amt. | Amt. | μm | Ω · cm |
| Example: | | | | | | | | | | | | |
| 1 | S-1 | AC-1 | 10 | R-1 | 100 | D-1 | 44.4 | D-2 | 11.1 | 11.1 | 1.19 | 0.83 |
| 2 | S-2 | AC-2 | 1.5 | R-1 | 100 | D-1 | 40.4 | D-2 | 10.1 | 10.1 | 1.24 | 1.29 |
| 3 | S-3 | AC-3 | 37.9 | R-1 | 100 | D-1 | 60.6 | D-2 | 15.2 | 15.2 | 1.21 | 0.73 |
| 4 | S-4 | AC-4 | 10 | R-1 | 100 | D-1 | 44.4 | D-2 | 11.1 | 11.1 | 1.18 | 0.84 |

TABLE 3-continued

| | Developer carrying member | Acrylic resin Type | Acrylic resin Amt. | Binder resin Type | Binder resin Amt. | Conductive particles Type | Conductive particles Amt. | Conductive particles Type | Conductive particles Amt. | Unevenness particles Amt. | Ra μm | Volume resistivity Ω · cm |
|---|---|---|---|---|---|---|---|---|---|---|---|---|
| | | | | | | | | | | Amt.: Amount (pbm) | | |
| 5 | S-5 | AC-5 | 8.3 | R-1 | 100 | D-1 | 53.3 | D-2 | 13.3 | 9.3 | 1.24 | 0.14 |
| 6 | S-6 | AC-6 | 10 | R-1 | 100 | D-1 | 44.4 | D-2 | 11.1 | 11.1 | 1.22 | 0.83 |
| 7 | S-7 | AC-7 | 10 | R-1 | 100 | D-1 | 44.4 | D-2 | 11.1 | 11.1 | 1.19 | 0.86 |
| 8 | S-8 | AC-8 | 10 | R-1 | 100 | D-1 | 55.6 | D-3 | 13.3 | 8.9 | 1.21 | 0.06 |
| 9 | S-9 | AC-9 | 10 | R-1 | 100 | D-1 | 44.4 | D-2 | 11.1 | 11.1 | 1.18 | 0.94 |
| 10 | S-10 | AC-10 | 10 | R-1 | 100 | D-1 | 44.4 | D-2 | 11.1 | 11.1 | 1.24 | 0.91 |
| 11 | S-11 | AC-11 | 10 | R-1 | 100 | D-1 | 44.4 | D-2 | 11.1 | 11.1 | 1.27 | 0.89 |
| 12 | S-12 | AC-12 | 10 | R-1 | 100 | D-1 | 44.4 | D-2 | 11.1 | 11.1 | 1.22 | 0.81 |
| 13 | S-13 | AC-13 | 10 | R-1 | 100 | D-1 | 44.4 | D-2 | 11.1 | 11.1 | 1.24 | 0.84 |
| 14 | S-14 | AC-14 | 44.4 | R-1 | 100 | D-1 | 63.5 | D-2 | 15.9 | 15.9 | 1.23 | 0.85 |
| 15 | S-15 | AC-15 | 0.80 | R-1 | 100 | D-1 | 39.2 | D-2 | 9.8 | 9.8 | 1.21 | 0.97 |
| 16 | S-18 | AC-1 | 10 | R-2 | 100 | D-1 | 44.4 | D-2 | 11.1 | 11.1 | 1.18 | 1.09 |
| 17 | S-17 | AC-1 | 10 | R-3 | 100 | D-1 | 44.4 | D-2 | 11.1 | 11.1 | 1.15 | 0.93 |
| 18 | S-18 | AC-1 | 10 | R-4 | 100 | D-1 | 44.4 | D-2 | 11.1 | 11.1 | 1.19 | 1.00 |
| 19 | S-19 | AC-16 | 1.5 | R-1 | 100 | D-1 | 44.4 | D-2 | 11.1 | 11.1 | 1.25 | 1.44 |
| Comparative Example: | | | | | | | | | | | | |
| 1 | S-29 | AC-17 | 10 | R-1 | 100 | D-1 | 44.4 | D-2 | 11.1 | 11.1 | 1.18 | 2.54 |
| 2 | S-30 | AC-18 | 10 | R-1 | 100 | D-1 | 44.4 | D-2 | 11.1 | 11.1 | 1.21 | 1.79 |
| 3 | S-31 | AC-19 | 10 | R-1 | 100 | D-1 | 44.4 | D-2 | 11.1 | 11.1 | 1.19 | 0.96 |
| 4 | S-32 | AC-20 | 10 | R-1 | 100 | D-1 | 44.4 | D-2 | 11.1 | 11.1 | 1.18 | 1.05 |
| 5 | S-33 | AC-21 | 10 | R-1 | 100 | D-1 | 44.4 | D-2 | 11.1 | 11.1 | 1.28 | 3.23 |
| 6 | S-34 | AC-22 | 10 | R-1 | 100 | D-1 | 44.4 | D-2 | 11.1 | 11.1 | 1.26 | 3.92 |
| 7 | S-35 | AC-23 | 10 | R-1 | 100 | D-1 | 44.4 | D-2 | 11.1 | 11.1 | 1.23 | 3.11 |
| 8 | S-36 | AC-24 | 10 | R-1 | 100 | D-1 | 44.4 | D-2 | 11.1 | 11.1 | 1.27 | 4.13 |
| 9 | S-37 | None | 0 | R-1 | 100 | D-1 | 44.4 | D-2 | 11.1 | 11.1 | 1.21 | 0.85 |
| 10 | S-38 | AC-1 | 10 | R-5 | 100 | D-1 | 44.4 | D-2 | 11.1 | 11.1 | 1.22 | 0.53 |
| 11 | S-39 | Z-1 | 10 | R-1 | 100 | D-1 | 44.4 | D-2 | 11.1 | 11.1 | 1.21 | 1.94 |

Z-1: COPY BLUE (trade name; available from Hoechst AG), used as a charge control agent.

TABLE 4

15k sh.: 15,000 sheets

| Example | Developer carrying member | Environment | Q/M (1) | Q/M (2) | Q/M Rate of chg. (1) | Q/M (3) | Q/M Rate of chg. (2) | M/S (1) | M/S (2) | M/S Rate of chg. (1) | M/S (3) | M/S Rate of chg. (2) | Image density Initial | Image density 15k sh. | Image density 5 days after |
|---|---|---|---|---|---|---|---|---|---|---|---|---|---|---|---|
| 1 | S-1 | L/L | −8.43 | −8.08 | 4.2% | −8.05 | 4.6% | 20.5 | 17.3 | 15.6% | 17.0 | 17.1% | A | A | A |
| | | N/N | −7.40 | −7.10 | 4.1% | −6.75 | 8.8% | 19.1 | 16.1 | 15.7% | 16.0 | 16.2% | A | A | A |
| | | H/H | −6.21 | −5.75 | 7.4% | −5.62 | 9.6% | 18.2 | 15.3 | 15.9% | 15.0 | 17.6% | A | A | A |
| 2 | S-2 | L/L | −8.22 | −7.85 | 4.5% | −7.67 | 6.7% | 20.1 | 17.0 | 15.4% | 16.1 | 19.9% | A | A | A |
| | | N/N | −7.15 | −6.75 | 5.6% | −6.29 | 12.0% | 19.0 | 15.5 | 18.4% | 14.8 | 22.1% | A | A | B |
| | | H/H | −6.08 | −5.45 | 10.4% | −5.26 | 13.5% | 18.1 | 14.7 | 18.8% | 13.4 | 26.0% | A | B | C |
| 3 | S-3 | L/L | −8.31 | −7.42 | 10.7% | −7.75 | 6.7% | 20.9 | 16.1 | 23.0% | 17.1 | 18.2% | A | B | A |
| | | N/N | −7.32 | −6.95 | 5.1% | −6.70 | 8.5% | 19.2 | 16.1 | 16.1% | 15.6 | 18.8% | A | A | A |
| | | H/H | −6.19 | −5.70 | 7.9% | −5.52 | 10.8% | 18.4 | 15.5 | 15.8% | 15.0 | 18.5% | A | A | A |
| 4 | S-4 | L/L | −8.18 | −7.75 | 5.3% | −7.65 | 6.5% | 20.3 | 17.1 | 15.8% | 16.3 | 19.7% | A | A | A |
| | | N/N | −7.18 | −6.75 | 6.0% | −6.29 | 12.4% | 19.2 | 15.8 | 17.7% | 14.9 | 22.4% | A | A | B |
| | | H/H | −6.08 | −5.60 | 7.9% | −5.27 | 13.3% | 18.0 | 14.7 | 18.3% | 14.1 | 21.7% | A | B | B |
| 5 | S-5 | L/L | −8.03 | −7.70 | 4.1% | −7.59 | 5.4% | 19.8 | 17.0 | 14.1% | 16.5 | 16.7% | A | A | A |
| | | N/N | −7.18 | −6.69 | 6.8% | −6.41 | 10.7% | 18.9 | 15.9 | 15.9% | 15.6 | 17.5% | A | A | A |
| | | H/H | −6.06 | −5.58 | 7.9% | −5.38 | 11.2% | 17.9 | 14.7 | 17.9% | 14.2 | 20.7% | A | B | B |
| 6 | S-6 | L/L | −8.59 | −7.42 | 13.6% | −7.75 | 9.7% | 22.1 | 16.2 | 26.7% | 17.0 | 23.1% | A | B | A |
| | | N/N | −7.49 | −6.55 | 12.6% | −6.81 | 9.1% | 20.4 | 16.1 | 21.1% | 15.8 | 22.5% | A | A | A |
| | | H/H | −6.22 | −5.73 | 7.9% | −5.59 | 10.1% | 18.6 | 15.6 | 16.1% | 15.1 | 18.8% | A | A | A |
| 7 | S-7 | L/L | −8.21 | −7.65 | 6.8% | −7.57 | 7.8% | 19.9 | 16.6 | 16.6% | 16.3 | 18.1% | A | A | A |
| | | N/N | −7.11 | −6.65 | 6.5% | −6.34 | 10.8% | 18.9 | 15.5 | 18.0% | 15.0 | 20.6% | A | A | B |
| | | H/H | −6.04 | −5.59 | 7.5% | −5.28 | 12.6% | 18.0 | 14.8 | 17.8% | 14.2 | 21.1% | A | B | B |
| 8 | S-8 | L/L | −8.09 | −7.68 | 5.1% | −7.65 | 5.5% | 20.4 | 17.1 | 16.2% | 16.6 | 18.6% | A | A | A |
| | | N/N | −7.21 | −6.69 | 7.2% | −6.44 | 10.7% | 19.1 | 16.0 | 16.2% | 15.9 | 16.8% | A | A | A |
| | | H/H | −6.21 | −5.70 | 8.2% | −5.53 | 11.0% | 18.2 | 15.1 | 17.0% | 14.8 | 18.7% | A | A | A |
| 9 | S-9 | L/L | −8.55 | −7.32 | 14.4% | −7.80 | 8.8% | 22.3 | 16.4 | 26.5% | 17.2 | 22.9% | A | B | A |
| | | N/N | −7.58 | −6.59 | 13.1% | −6.84 | 9.8% | 20.6 | 16.1 | 21.8% | 15.9 | 22.8% | A | A | A |
| | | H/H | −6.29 | −5.79 | 7.9% | −5.56 | 11.6% | 18.8 | 15.6 | 17.0% | 15.1 | 19.7% | A | A | A |

TABLE 4-continued 15k sh.: 15,000 sheets

| Example | Developer carrying member | Environment | Ghosts Initial | Ghosts 15k sh. | Blotches Initial | Blotches 15k sh. | Image quality Initial | Image quality 15k sh. | Fog Initial | Fog 15k sh. |
|---|---|---|---|---|---|---|---|---|---|---|
| 1 | S-1 | L/L | A | A | A | A | A | A | A | A |
| | | N/N | A | A | A | A | A | A | A | A |
| | | H/H | A | A | A | A | A | A | A | A |
| 2 | S-2 | L/L | A | A | A | A | A | A | A | A |
| | | N/N | A | B | A | A | A | A | A | B |
| | | H/H | A | B | A | A | A | C | A | C |
| 3 | S-3 | L/L | B | A | A | A | A | A | B | B |
| | | N/N | A | A | A | A | A | A | A | A |
| | | H/H | A | A | A | A | A | A | A | A |
| 4 | S-4 | L/L | B | A | A | A | A | A | B | A |
| | | N/N | A | B | A | A | A | A | A | B |
| | | H/H | A | B | A | A | A | B | A | B |
| 5 | S-5 | L/L | A | A | A | A | A | A | A | A |
| | | N/N | A | A | A | A | A | A | A | B |
| | | H/H | A | A | A | A | A | B | A | B |
| 6 | S-6 | L/L | B | B | B | B | A | A | B | A |
| | | N/N | B | A | A | A | A | A | A | A |
| | | H/H | A | A | A | A | A | A | A | A |
| 7 | S-7 | L/L | A | A | A | A | A | A | B | A |
| | | N/N | A | B | A | A | A | A | A | B |
| | | H/H | A | B | A | A | A | B | A | B |
| 8 | S-8 | L/L | A | A | A | A | A | A | B | A |
| | | N/N | A | A | A | A | A | A | A | A |
| | | H/H | A | B | A | A | A | A | A | A |
| 9 | S-9 | L/L | B | B | B | A | A | A | B | B |
| | | N/N | A | A | A | A | A | A | B | B |
| | | H/H | A | A | A | A | A | A | A | A |

TABLE 5

15k sh.: 15,000 sheets

| Example | Developer carrying member | Environment | Q/M (1) | Q/M (2) | Q/M Rate of chg. (1) | Q/M (3) | Q/M Rate of chg. (2) | M/S (1) | M/S (2) | M/S Rate of chg. (1) | M/S (3) | M/S Rate of chg. (2) | Image density Initial | Image density 15k sh. | Image density 5 days after |
|---|---|---|---|---|---|---|---|---|---|---|---|---|---|---|---|
| 10 | S-10 | L/L | −8.38 | −8.00 | 4.5% | −7.88 | 5.9% | 21.0 | 17.4 | 17.1% | 16.9 | 19.5% | A | A | A |
| | | N/N | −7.45 | −7.09 | 4.8% | −6.74 | 9.5% | 19.4 | 16.3 | 16.0% | 16.0 | 17.5% | A | A | A |
| | | H/H | −6.11 | −5.65 | 7.5% | −5.52 | 9.7% | 18.3 | 15.4 | 15.8% | 15.0 | 18.0% | A | A | A |
| 11 | S-11 | L/L | −8.36 | −7.98 | 4.5% | −7.81 | 6.6% | 20.7 | 17.3 | 16.4% | 17.0 | 17.9% | A | A | A |
| | | N/N | −7.33 | −6.79 | 7.4% | −6.62 | 9.7% | 19.2 | 16.1 | 16.1% | 15.8 | 17.7% | A | A | A |
| | | H/H | −6.19 | −5.59 | 9.7% | −5.51 | 11.0% | 18.4 | 15.5 | 15.8% | 15.0 | 18.5% | A | A | A |
| 12 | S-12 | L/L | −8.66 | −7.32 | 15.5% | −7.68 | 11.3% | 23.1 | 17.2 | 25.5% | 16.8 | 27.3% | A | B | A |
| | | N/N | −7.59 | −6.60 | 13.0% | −6.84 | 9.9% | 21.0 | 16.4 | 21.9% | 15.9 | 24.3% | A | A | A |
| | | H/H | −6.41 | −5.83 | 9.0% | −5.79 | 9.7% | 18.9 | 15.6 | 17.5% | 15.3 | 19.0% | A | A | A |
| 13 | S-13 | L/L | −8.02 | −7.65 | 4.6% | −7.53 | 6.1% | 19.2 | 16.3 | 15.1% | 16.0 | 16.7% | A | B | A |
| | | N/N | −7.04 | −6.45 | 8.4% | −6.27 | 10.9% | 18.2 | 15.1 | 17.0% | 14.8 | 18.7% | A | B | B |
| | | H/H | −5.99 | −5.25 | 12.4% | −5.25 | 12.4% | 17.3 | 14.3 | 17.3% | 13.9 | 19.7% | A | C | C |
| 14 | S-14 | L/L | −8.13 | −7.68 | 5.5% | −7.55 | 7.1% | 20.4 | 16.9 | 17.2% | 16.5 | 19.1% | A | A | A |
| | | N/N | −7.28 | −6.61 | 9.2% | −6.45 | 11.4% | 19.0 | 16.1 | 15.3% | 15.5 | 18.4% | A | A | A |
| | | H/H | −6.02 | −5.45 | 9.5% | −5.29 | 12.1% | 18.0 | 14.8 | 17.8% | 14.3 | 20.6% | A | B | B |
| 15 | S-15 | L/L | −8.06 | −7.55 | 6.3% | −7.48 | 7.1% | 19.0 | 16.1 | 15.3% | 15.8 | 16.8% | A | A | A |
| | | N/N | −6.90 | −6.44 | 6.7% | −6.17 | 10.6% | 17.9 | 15.0 | 16.2% | 14.7 | 17.9% | A | B | B |
| | | H/H | −6.01 | −5.33 | 11.3% | −5.22 | 13.1% | 17.1 | 14.2 | 17.0% | 13.9 | 18.7% | A | C | C |
| 16 | S-16 | L/L | −8.19 | −7.62 | 7.0% | −7.39 | 9.8% | 20.1 | 16.6 | 17.4% | 16.3 | 18.9% | A | B | A |
| | | N/N | −7.18 | −6.60 | 8.1% | −6.34 | 11.7% | 18.9 | 15.7 | 16.9% | 15.4 | 18.5% | A | A | A |
| | | H/H | −6.08 | −5.51 | 9.4% | −5.34 | 12.3% | 18.1 | 15.0 | 17.1% | 14.4 | 20.4% | A | B | B |
| 17 | S-17 | L/L | −8.12 | −7.49 | 7.8% | −7.46 | 8.1% | 20.4 | 16.8 | 17.6% | 16.0 | 21.6% | A | B | A |
| | | N/N | −7.15 | −6.59 | 7.8% | −6.34 | 11.3% | 18.8 | 15.6 | 17.0% | 15.2 | 19.1% | A | A | A |
| | | H/H | −6.01 | −5.41 | 10.0% | −5.30 | 11.8% | 18.0 | 14.9 | 17.2% | 14.4 | 20.0% | A | B | B |
| 18 | S-18 | L/L | −7.98 | −7.54 | 5.5% | −7.55 | 5.4% | 19.0 | 16.1 | 15.3% | 15.9 | 16.3% | A | B | A |
| | | N/N | −6.96 | −6.24 | 10.3% | −6.14 | 11.8% | 17.9 | 14.9 | 16.8% | 14.6 | 18.4% | A | B | B |
| | | H/H | −5.89 | −5.24 | 11.0% | −5.17 | 12.2% | 17.0 | 14.3 | 15.9% | 13.9 | 18.2% | A | B | C |

TABLE 5-continued 15k sh.: 15,000 sheets

| | | | | | | | | | | | | | | | |
|---|---|---|---|---|---|---|---|---|---|---|---|---|---|---|---|
| 19 | S-19 | L/L | −8.10 | −7.60 | 6.2% | −7.45 | 8.0% | 21.4 | 17.9 | 16.4% | 17.2 | 19.6% | A | A | A |
| | | N/N | −7.09 | −6.60 | 6.9% | −6.35 | 10.4% | 19.4 | 16.2 | 16.5% | 15.9 | 18.0% | A | A | A |
| | | H/H | −6.19 | −5.59 | 9.7% | −5.41 | 12.6% | 17.8 | 15.0 | 15.7% | 14.4 | 19.1% | A | B | B |

| | Developer | | Ghosts | | Blotches | | Image quality | | Fog | |
|---|---|---|---|---|---|---|---|---|---|---|
| Example | carrying member | Environment | Initial | 15k sh. | Initial | 15k sh. | Initial | 15k sh. | Initial | 15k sh. |
| 10 | S-10 | L/L | B | A | A | A | A | A | A | B |
| | | N/N | A | A | A | A | A | A | A | A |
| | | H/H | A | A | A | A | A | A | A | A |
| 11 | S-11 | L/L | B | A | A | A | A | A | B | A |
| | | N/N | A | A | A | A | A | A | A | A |
| | | H/H | A | A | A | A | A | A | A | A |
| 12 | S-12 | L/L | C | B | A | B | A | A | B | B |
| | | N/N | B | A | A | A | A | A | A | A |
| | | H/H | A | A | A | A | A | A | A | A |
| 13 | S-13 | L/L | B | A | A | B | A | A | B | A |
| | | N/N | A | B | A | A | A | A | A | B |
| | | H/H | A | C | A | A | A | C | A | B |
| 14 | S-14 | L/L | B | A | A | B | A | A | B | A |
| | | N/N | A | A | A | A | A | A | A | B |
| | | H/H | A | B | A | A | A | A | A | B |
| 15 | S-15 | L/L | A | A | A | B | A | A | A | B |
| | | N/N | A | B | A | A | A | A | A | B |
| | | H/H | A | C | A | A | A | C | A | C |
| 16 | S-16 | L/L | B | A | A | B | A | A | A | B |
| | | N/N | A | A | A | A | A | A | A | B |
| | | H/H | A | A | A | A | A | B | A | A |
| 17 | S-17 | L/L | B | A | A | B | A | A | A | B |
| | | N/N | A | A | A | A | A | A | A | B |
| | | H/H | A | A | A | A | A | B | A | A |
| 18 | S-18 | L/L | B | B | A | B | A | A | B | B |
| | | N/N | A | A | A | A | A | A | A | B |
| | | H/H | A | A | A | A | A | C | A | A |
| 19 | S-19 | L/L | C | B | A | B | A | A | B | A |
| | | N/N | B | B | A | A | A | A | B | A |
| | | H/H | A | B | A | A | A | A | A | B |

TABLE 6

15k sh.: 15,000 sheets

| | | | Q/M | | | | | M/S | | | | | Image density | | |
|---|---|---|---|---|---|---|---|---|---|---|---|---|---|---|---|
| Comp Ex | Developer carrying member | Environment | (1) | (2) | Rate of chg. (1) | (3) | Rate of chg. (2) | (1) | (2) | Rate of chg. (1) | (3) | Rate of chg. (2) | Initial | 15k sh. | 5 days after |
| 1 | S-29 | L/L | −8.01 | −5.82 | 27.3% | −6.48 | 19.1% | 22.9 | 19.2 | 16.2% | 16.8 | 26.6% | B | C | B |
| | | N/N | −6.89 | −5.55 | 19.4% | −5.51 | 20.0% | 20.3 | 16.5 | 18.7% | 14.8 | 27.1% | A | B | B |
| | | H/H | −6.11 | −5.28 | 13.6% | −4.64 | 24.1% | 17.7 | 14.2 | 19.8% | 13.9 | 21.5% | A | B | B |
| 2 | S-30 | L/L | −8.09 | −6.05 | 25.2% | −6.33 | 21.8% | 23.2 | 19.4 | 16.4% | 17.0 | 26.7% | B | C | B |
| | | N/N | −6.99 | −5.58 | 20.2% | −5.59 | 20.0% | 20.5 | 16.7 | 18.5% | 14.9 | 27.3% | A | B | B |
| | | H/H | −6.18 | −5.22 | 15.5% | −4.81 | 22.2% | 18.1 | 14.3 | 21.0% | 14.0 | 22.7% | A | B | B |
| 3 | S-31 | L/L | −7.61 | −6.21 | 18.4% | −4.88 | 35.9% | 19.5 | 16.8 | 13.8% | 16.0 | 17.9% | A | B | C |
| | | N/N | −6.44 | −5.32 | 17.4% | −4.10 | 36.3% | 18.5 | 15.5 | 16.2% | 14.8 | 20.0% | A | B | C |
| | | H/H | −5.51 | −4.28 | 22.3% | −3.35 | 39.2% | 18.1 | 14.0 | 22.7% | 12.9 | 28.7% | A | C | E |
| 4 | S-32 | L/L | −8.05 | −6.11 | 24.1% | −6.39 | 20.6% | 23.1 | 19.2 | 16.9% | 16.7 | 27.7% | B | C | B |
| | | N/N | −7.05 | −5.61 | 20.4% | −5.59 | 20.7% | 20.0 | 16.2 | 19.0% | 14.9 | 25.5% | A | B | B |
| | | H/H | −6.18 | −5.21 | 15.7% | −4.78 | 22.7% | 17.8 | 14.6 | 18.0% | 14.2 | 20.2% | A | B | B |
| 5 | S-33 | L/L | −7.38 | −6.01 | 18.6% | −4.78 | 35.2% | 19.2 | 16.6 | 13.5% | 15.9 | 17.2% | A | B | C |
| | | N/N | −6.30 | −5.11 | 18.9% | −4.02 | 36.2% | 18.4 | 15.4 | 16.3% | 14.6 | 20.7% | A | C | C |
| | | H/H | −5.45 | −4.01 | 26.4% | −3.21 | 41.1% | 17.8 | 14.3 | 19.7% | 12.8 | 28.1% | A | D | E |
| 6 | S-34 | L/L | −8.12 | −5.15 | 36.6% | −5.59 | 31.2% | 24.3 | 17.2 | 29.2% | 16.8 | 30.9% | A | E | D |
| | | N/N | −7.22 | −5.44 | 24.7% | −5.56 | 23.0% | 19.9 | 16.4 | 17.6% | 14.9 | 25.1% | A | C | B |
| | | H/H | −6.22 | −5.05 | 18.8% | −4.65 | 25.2% | 18.0 | 14.8 | 17.8% | 14.3 | 20.6% | A | B | B |
| 7 | S-35 | L/L | −7.44 | −5.21 | 30.0% | −4.98 | 33.1% | 19.5 | 16.4 | 15.9% | 15.8 | 19.0% | A | C | B |
| | | N/N | −6.33 | −4.87 | 23.1% | −4.08 | 35.5% | 18.2 | 15.5 | 14.8% | 14.4 | 20.9% | A | B | B |
| | | H/H | −5.49 | −4.11 | 25.1% | −3.26 | 40.6% | 17.9 | 14.2 | 20.7% | 12.9 | 27.9% | A | D | E |
| 8 | S-36 | L/L | −8.17 | −5.09 | 37.7% | −5.60 | 31.5% | 24.4 | 17.3 | 29.1% | 16.7 | 31.6% | A | E | D |
| | | N/N | −7.19 | −5.35 | 25.6% | −5.54 | 22.9% | 20.1 | 16.6 | 17.4% | 15.1 | 24.9% | A | C | B |
| | | H/H | −6.12 | −5.10 | 16.7% | −4.75 | 22.4% | 18.2 | 14.9 | 18.1% | 14.4 | 20.9% | A | B | B |

TABLE 6-continued 15k sh.: 15,000 sheets

| | | | | | | | | | | | | | | | |
|---|---|---|---|---|---|---|---|---|---|---|---|---|---|---|---|
| 9 | S-37 | L/L | −7.04 | −5.99 | 14.9% | −4.34 | 38.4% | 19.3 | 16.5 | 14.5% | 15.5 | 19.7% | A | A | C |
| | | N/N | −6.10 | −4.81 | 21.1% | −3.55 | 41.8% | 18.3 | 15.2 | 16.9% | 14.4 | 21.3% | A | C | E |
| | | H/H | −5.10 | −3.48 | 31.8% | −2.99 | 41.4% | 17.8 | 14.2 | 20.2% | 12.6 | 29.2% | A | E | F |
| 10 | S-38 | L/L | −8.13 | −7.72 | 5.0% | −7.01 | 13.8% | 20.1 | 14.0 | 30.3% | 13.1 | 34.8% | A | C | C |
| | | N/N | −7.22 | −6.95 | 3.7% | −6.10 | 15.5% | 19.0 | 12.9 | 32.1% | 12.2 | 35.8% | A | D | F |
| | | H/H | −6.11 | −5.65 | 7.5% | −5.09 | 16.7% | 17.7 | 11.0 | 37.9% | 10.4 | 41.2% | A | F | F |
| 11 | S-39 | L/L | −7.65 | −5.65 | 26.1% | −5.32 | 30.5% | 21.9 | 17.4 | 20.5% | 16.6 | 24.2% | A | B | B |
| | | N/N | −7.32 | −5.43 | 25.8% | −4.99 | 31.8% | 19.6 | 15.9 | 18.9% | 14.9 | 24.0% | A | B | C |
| | | H/H | −6.01 | −4.56 | 24.1% | −4.49 | 25.3% | 18.0 | 14.6 | 18.9% | 14.0 | 22.2% | A | C | C |

| | Developer | | Ghosts | | Blotches | | Image quality | | Fog | |
|---|---|---|---|---|---|---|---|---|---|---|
| Copm Ex | carrying member | Environment | Initial | 15k sh. | Initial | 15k sh. | Initial | 15k sh. | Initial | 15k sh. |
| 1 | S-29 | L/L | D | B | B | D | A | B | E | C |
| | | N/N | C | B | A | B | A | B | B | B |
| | | H/H | A | A | A | A | A | B | B | B |
| 2 | S-30 | L/L | D | B | B | D | A | B | E | C |
| | | N/N | C | B | A | B | A | B | B | B |
| | | H/H | A | A | A | A | A | C | B | C |
| 3 | S-31 | L/L | A | B | A | A | A | A | A | B |
| | | N/N | B | C | A | A | A | C | B | C |
| | | H/H | B | D | A | A | A | D | B | E |
| 4 | S-32 | L/L | D | C | B | C | A | A | E | D |
| | | N/N | C | B | A | B | A | B | C | C |
| | | H/H | B | A | A | A | A | B | B | B |
| 5 | S-33 | L/L | B | B | A | B | A | A | A | B |
| | | N/N | B | C | A | B | A | B | B | E |
| | | H/H | B | D | A | A | A | D | B | E |
| 6 | S-34 | L/L | E | C | B | E | A | A | E | E |
| | | N/N | C | C | B | C | A | B | E | B |
| | | H/H | C | B | A | A | A | B | B | B |
| 7 | S-35 | L/L | C | A | B | B | A | A | B | E |
| | | N/N | B | C | A | B | A | C | B | C |
| | | H/H | A | D | A | A | A | C | B | E |
| 8 | S-36 | L/L | E | C | C | E | A | C | E | F |
| | | N/N | C | C | B | C | A | B | E | D |
| | | H/H | C | B | A | A | A | B | B | B |
| 9 | S-37 | L/L | B | B | A | B | A | B | B | B |
| | | N/N | B | C | A | B | B | C | B | E |
| | | H/H | C | D | A | A | B | D | B | F |
| 10 | S-38 | L/L | A | B | A | D | A | B | C | F |
| | | N/N | A | D | A | D | A | B | B | E |
| | | H/H | A | E | A | B | A | D | B | E |
| 11 | S-39 | L/L | A | A | B | E | A | B | C | F |
| | | N/N | A | B | A | C | A | B | A | C |
| | | H/H | A | C | A | A | A | C | B | B |

Comp Ex: Comparative Example

From the results shown in the above Tables 4 to 6, the developer carrying member according to the present invention can be understood to be remarkably effective. That is, as to each Example, the resin layer of the developer carrying member was improved in its hydrophobicity because a long-chain alkyl group having 8 to 18 carbon atoms and a long-chain alkyl group having 4 to 18 carbon atoms were introduced into the ester unit (1) and the cationic unit (2), respectively, which constitute the acrylic resin. Hence, electrophotographic images having a high image density were obtained stably even in the H/H environment. On the other hand, in Comparative Examples 5 and 7, each making use of a developing roller incorporated with an acrylic resin the cationic unit and ester unit of which did not have any long-chain alkyl group, the image density was seen to come greatly low in the H/H environment. In addition, solid images reproduced 5 days after the running test was finished also resulted in a low image density.

In virtue of the introduction of the long-chain alkyl group into the ester unit (1), the acrylic resin was improved in its compatibility with the binder resin thermosetting resin. Hence, this enabled the toner to be provided with uniform triboelectric charges, so that the toner was kept from coming charged in excess or low charged. In virtue of these effects, the present invention was achievable of the level C or higher about the ghosts, the level B or higher about the blotches and the level C or higher about the fog, even in various environments. On the other hand, in Comparative Examples 1 and 2, which differ from Example 1 in that each made use of an acrylic resin containing an ester unit not having any long-chain alkyl group, the acrylic resin had an insufficient dispersibility in the thermosetting resin. Hence, the images reproduced in the L/L environment were seen to have caused blotches at the level D as well as fog.

Further, in virtue of the introduction of the long-chain alkyl group into the quaternary ammonium base of the cationic unit (2), the developer carrying member was more improved in charge-providing performance to the toner. As the result, the images reproduced at the initial stage, after reproduction on 15,000 sheets and 5 days after reproduction on 15,000 sheets were stably achievable of the level C or higher in every environment, in light of their evaluation criteria. On the other hand, in the developer carrying members according to Comparative Examples 3, 5 and 7, the cationic unit (2) of the acrylic resin in each of their resin layers did not have any long-chain alkyl group, and hence any sufficient charge-providing ability was obtainable. Hence, the image densities of solid images reproduced at the 5th day after reproduction on 15,000 sheets were all at the level E or lower.

In the developer carrying member according to Comparative Example 9, the resin layer the acrylic resin did not contain any acrylic resin, and hence its charge-providing ability was so low that the image densities of solid images reproduced after 15,000-sheet running evaluation and 5 days thereafter were all at the level F.

EXAMPLE 20

A mixture of the following materials was prepared. The following materials were mixed in 170.6 parts by mass (79.6 parts as solid content) of the above coating material intermediate M-1.

| | |
|---|---|
| Binder resin R-1 | 65.9 parts by mass as solid content |
| Acrylic resin AC-1 | 8.2 parts by mass as solid content |
| Surface unevenness-providing spherical particles (available from Nippon Carbon Co., Ltd.; trade name: ICB0520) | 9.1 parts by mass |

The mixture obtained was put to dispersion for 40 minutes by means of a sand mill making use of glass beads of 1.5 mm in diameter as media particles to obtain a coating fluid. With this coating fluid, a cylindrical tube made of aluminum and having an outer diameter of 24.5 mm, which was stood upright, masked at its top and bottom portions and rotated at a constant speed, was coated while a spray gun was descended at a constant speed, to form a resin layer on the tube. Subsequently, the resin layer was hardened by heating it for 40 minutes in a 150° C. hot-air drying oven, to produce a developer carrying member, S-20. Make-up of the resin layer of the developer carrying member S-20 is shown in Table 7.

A magnet roller was inserted to the developer carrying member S-20 obtained, and this developer carrying member was mounted, as a developing roller, to a developing apparatus of a digital composite machine (trade name: iR5075N; manufactured by CANON INC.). Here, its gear ratio was so changed that the peripheral speed of the developer carrying member with respect to the peripheral speed of the photosensitive drum came to 125%. The gap between its magnetic doctor blade and the developer carrying member was set to 280 μm. Also, as its developer, the developer T-2 was used, which was prepared as described previously.

(1) Toner Charge Quantity (Q/M) and Toner Transport Quantity (M/S) on Developer Carrying Member:

The above digital composite machine was left for 24 hours in a normal-temperature and low-humidity environment (23° C., 10% RH; N/L) in the state it was disconnected. Thereafter, the machine was switched on, and solid black images were reproduced. The toner carried on the developer carrying member at this point was collected by suction through a metal cylindrical tube and a cylindrical filter, where toner charge quantity per unit mass Q/M (mC/kg) and toner transport quantity per unit area M/S (g/m$^2$) were calculated from the charge quantity Q accumulated in a capacitor through the metal cylindrical tube, the mass M of the toner collected and the area S over which the toner was sucked. The values found are taken as "Q/M(1)" and "M/S(1)", respectively.

Next, in the N/L environment, character images of 4% in print percentage were reproduced on 500,000 sheets in A4-breadthwise paper feed, and subsequently solid black images were reproduced. About the toner carried on the developer carrying member at this point, the Q/M and the M/S were calculated in the same way as the above. The values found are taken as "Q/M(2)" and "M/S(2)", respectively. Further thereafter, the digital composite machine was left for 5 days in the N/L environment in the state it was disconnected. Then the machine was again switched on, and solid black images were reproduced. The Q/M and M/S of the toner carried on the developer carrying member at this point were calculated in the same way as the above. The values found are taken as "Q/M(3)" and "M/S(3)", respectively.

A series of the above evaluation was also made in a normal-temperature and normal-humidity environment (23° C., 50% RH; N/N) and in a high-temperature and high-humidity environment (32° C., 85% RH; H/H). "Q/M(1)" "Q/M(2)" and "Q/M(3)" in each environment and the rates of change (1) and (2) in "Q/M(2)" and "Q/M(3)" with respect to "Q/M(1)" are shown in Table 8. Similarly, "M/S(1)" "M/S(2)" and "M/S (3)" and the rates of change in "M/S(2)" and "M/S(3)" with respect to "M/S(1)" are shown in Table 8.

(2) Image Density:

Solid black images were reproduced both before images were reproduced in the above character pattern and after images having the above character pattern were reproduced on 500,000 sheets. Also, in order to evaluate a rise in triboelectric charging, the above character images were reproduced on 500,000 sheets and thereafter the digital composite machine was left for 5 days in the normal-temperature and normal-humidity environment in the state it was disconnected. Thereafter, solid black images were reproduced. On each of the solid black images thus obtained on three sheets, image density was measured to make evaluation by the same criteria as those in Example 1.

(3) Ghosts:

A pattern was used in which, in an image pattern to be reproduced on the digital composite machine, a region corresponding to the developer carrying member one round at the top of the image pattern is held by solid-black square (20 mm each side) images arranged at regular intervals on a white background and the other region by a halftone image. Reproduced images were ranked by how ghosts of the square images appear on the halftone image. Evaluation was made by the same criteria as those in Example 1.

(4) Fog:

Evaluation was made by the same method and criteria as those in Example 1.

(5) Image Quality:

Evaluation was made by the same method and criteria as those in Example 1.

EXAMPLES 21 TO 24 & COMPARATIVE EXAMPLES 12 TO 15

Developer carrying members S-21 to S-24 and S-40 and S-43 were produced in the same way as in Example 20 but under formulation shown in Table 7, and were evaluated in the same way as in Example 20.

The results of Examples 20 to 24 and Comparative Examples 12 to 15 are shown in Table 8.

TABLE 7

| Characteristics of Developer Carrying Member | | | | | | | | | | | | |
|---|---|---|---|---|---|---|---|---|---|---|---|---|
| | Developer carrying member | Acrylic resin Type | Acrylic resin Amt. (pbm) | Binder resin Type | Binder resin Amt. (pbm) | Conductive particles Type | Conductive particles Amt. (pbm) | Conductive particles Type | Conductive particles Amt. (pbm) | Unevenness particles Amt. (pbm) | Ra μm | Volume resistivity Ω · cm |
| Example: | | | | | | | | | | | | |
| 20 | S-20 | AC-1 | 8.2 | R-1 | 100 | D-1 | 36.4 | D-2 | 9.1 | 9.1 | 0.72 | 1.52 |
| 21 | S-21 | AC-4 | 8.2 | R-1 | 100 | D-1 | 36.4 | D-2 | 9.1 | 9.1 | 0.74 | 1.36 |
| 22 | S-22 | AC-6 | 8.2 | R-1 | 100 | D-1 | 36.4 | D-2 | 9.1 | 9.1 | 0.69 | 1.23 |
| 23 | S-23 | AC-7 | 8.2 | R-1 | 100 | D-1 | 36.4 | D-2 | 9.1 | 9.1 | 0.74 | 1.12 |
| 24 | S-24 | AC-9 | 8.2 | R-1 | 100 | D-1 | 36.4 | D-2 | 9.1 | 9.1 | 0.71 | 1.52 |
| Comparative Example: | | | | | | | | | | | | |
| 12 | S-40 | AC-20 | 8.2 | R-1 | 100 | D-1 | 36.4 | D-2 | 9.1 | 9.1 | 0.69 | 4.12 |
| 13 | S-41 | AC-23 | 8.2 | R-1 | 100 | D-1 | 36.4 | D-2 | 9.1 | 9.1 | 0.73 | 5.16 |
| 14 | S-42 | None | 0 | R-1 | 100 | D-1 | 36.4 | D-2 | 9.1 | 9.1 | 0.68 | 1.49 |
| 15 | S-43 | AC-1 | 8.2 | R-5 | 100 | D-1 | 36.4 | D-2 | 9.1 | 9.1 | 0.72 | 1.72 |

TABLE 8

500k sh.: 500,000 sheets

| | Developer carrying member | Environment | Q/M (1) | Q/M (2) | Q/M Rate of chg. (1) | Q/M (3) | Q/M Rate of chg. (2) | M/S (1) | M/S (2) | M/S Rate of chg. (1) | M/S (3) | M/S Rate of chg. (2) |
|---|---|---|---|---|---|---|---|---|---|---|---|---|
| Ex. 20 | S-20 | N/L | −5.91 | −5.51 | 6.8% | −5.41 | 8.5% | 11.2 | 10.1 | 9.8% | 9.9 | 11.6% |
| | | N/N | −5.63 | −5.26 | 6.5% | −5.14 | 8.7% | 10.9 | 9.6 | 11.9% | 9.5 | 12.8% |
| | | H/H | −4.68 | −4.33 | 7.6% | −4.24 | 9.4% | 10.6 | 9.1 | 14.2% | 8.9 | 16.0% |
| Ex. 21 | S-21 | N/L | −5.66 | −5.27 | 6.8% | −5.14 | 9.2% | 11.1 | 10.0 | 9.9% | 9.6 | 13.5% |
| | | N/N | −5.38 | −5.04 | 6.4% | −4.77 | 11.3% | 10.6 | 9.4 | 11.3% | 9.2 | 13.2% |
| | | H/H | −4.54 | −4.13 | 9.0% | −3.91 | 13.9% | 10.6 | 9.1 | 14.2% | 8.9 | 16.0% |
| Ex. 22 | S-22 | N/L | −5.78 | −5.20 | 10.0% | −5.26 | 9.0% | 11.1 | 10.0 | 9.9% | 9.6 | 13.5% |
| | | N/N | −5.44 | −5.14 | 5.5% | −4.92 | 9.6% | 10.9 | 9.6 | 11.9% | 9.5 | 12.8% |
| | | H/H | −4.66 | −4.32 | 7.4% | −4.13 | 11.4% | 10.7 | 9.3 | 13.1% | 8.7 | 18.7% |
| Ex. 23 | S-23 | N/L | −5.71 | −5.30 | 7.1% | −5.15 | 9.8% | 11.0 | 9.9 | 10.0% | 9.6 | 12.7% |
| | | N/N | −5.41 | −5.10 | 5.8% | −4.92 | 9.1% | 10.7 | 9.4 | 12.1% | 9.3 | 13.1% |
| | | H/H | −4.61 | −4.20 | 8.8% | −4.04 | 12.4% | 10.6 | 9.2 | 13.2% | 9.0 | 15.1% |
| Ex. 24 | S-24 | N/L | −5.80 | −5.16 | 11.0% | −5.22 | 10.0% | 11.0 | 9.8 | 10.9% | 9.6 | 12.7% |
| | | N/N | −5.51 | −5.10 | 7.5% | −4.99 | 9.4% | 10.8 | 9.7 | 10.2% | 9.5 | 12.0% |
| | | H/H | −4.72 | −4.32 | 8.6% | −4.21 | 10.8% | 10.6 | 9.3 | 12.3% | 8.8 | 17.0% |
| Cp. 12 | S-40 | N/L | −5.31 | −4.45 | 16.2% | −4.21 | 20.7% | 11.0 | 9.9 | 10.0% | 9.6 | 12.7% |
| | | N/N | −4.99 | −4.10 | 17.8% | −3.69 | 26.1% | 10.7 | 9.4 | 12.1% | 9.3 | 13.1% |
| | | H/H | −4.31 | −3.44 | 20.2% | −2.79 | 35.3% | 10.5 | 9.2 | 12.4% | 8.7 | 17.1% |
| Cp. 13 | S-41 | N/L | −5.64 | −4.21 | 25.4% | −4.75 | 15.8% | 11.3 | 9.7 | 14.2% | 9.7 | 14.2% |
| | | N/N | −5.22 | −4.24 | 18.8% | −4.31 | 17.4% | 11.0 | 9.4 | 14.5% | 9.3 | 15.5% |
| | | H/H | −4.55 | −3.96 | 13.0% | −3.62 | 20.4% | 10.6 | 9.3 | 12.3% | 9.0 | 15.1% |
| Cp. 14 | S-42 | N/L | −5.01 | −4.11 | 18.0% | −3.75 | 25.1% | 11.0 | 9.8 | 10.9% | 9.5 | 13.6% |
| | | N/N | −4.74 | −3.78 | 20.3% | −3.01 | 36.5% | 10.8 | 9.4 | 13.0% | 9.3 | 13.9% |
| | | H/H | −4.01 | −3.12 | 22.2% | −2.34 | 41.6% | 10.5 | 9.0 | 14.3% | 8.7 | 17.1% |
| Cp. 15 | S-43 | N/L | −5.80 | −5.21 | 10.2% | −5.02 | 13.4% | 11.0 | 8.2 | 25.5% | 7.9 | 28.2% |
| | | N/N | −5.55 | −5.02 | 9.5% | −4.88 | 12.1% | 10.8 | 6.5 | 39.8% | 5.4 | 50.0% |
| | | H/H | −4.58 | −4.01 | 12.4% | −3.99 | 12.9% | 10.7 | 5.1 | 52.3% | 4.5 | 57.9% |

| | Developer carrying member | Environment | Image density Initial | Image density 500k sh. | Image density 5 days after | Ghosts Initial | Ghosts 500k sh. | Blotches Initial | Blotches 500k sh. | Image quality Initial | Image quality 500k sh. | Fog Initial | Fog 500k sh. |
|---|---|---|---|---|---|---|---|---|---|---|---|---|---|
| Ex. 20 | S-20 | N/L | A | A | A | A | A | A | A | A | A | A | A |
| | | N/N | A | A | A | A | A | A | A | A | A | A | A |
| | | H/H | A | A | A | A | A | A | A | A | A | A | A |
| Ex. 21 | S-21 | N/L | A | A | B | A | A | A | A | A | A | A | A |
| | | N/N | A | B | B | A | A | A | A | A | B | A | A |
| | | H/H | A | B | C | A | A | A | A | B | B | A | B |
| Ex. 22 | S-22 | N/L | A | A | A | B | B | B | B | A | B | A | B |
| | | N/N | A | A | A | A | B | A | B | A | A | A | A |
| | | H/H | A | A | B | A | A | A | A | A | A | A | A |

TABLE 8-continued 500k sh.: 500,000 sheets

| | | | | | | | | | | | | | |
|---|---|---|---|---|---|---|---|---|---|---|---|---|---|
| Ex. | S-23 | N/L | A | A | A | A | A | A | A | A | A | A | A |
| 23 | | N/N | A | A | B | A | A | A | A | A | A | A | A |
| | | H/H | B | B | C | A | A | A | A | B | B | A | B |
| Ex. | S-24 | N/L | A | A | A | B | B | B | C | A | B | A | C |
| 24 | | N/N | A | A | A | A | B | A | B | A | A | A | B |
| | | H/H | A | A | B | A | A | A | A | A | A | A | A |
| Cp. | S-40 | N/L | A | B | B | B | C | B | C | A | A | A | B |
| 12 | | N/N | B | C | C | A | C | A | C | B | C | A | B |
| | | H/H | B | C | E | A | B | A | A | B | D | A | C |
| Cp. | S-41 | N/L | A | A | A | B | E | C | E | A | A | A | E |
| 13 | | N/N | A | B | B | B | D | B | D | A | A | A | B |
| | | H/H | A | B | C | A | C | A | C | B | C | A | A |
| Cp. | S-42 | N/L | A | B | B | A | A | A | A | B | C | A | A |
| 14 | | N/N | B | C | E | A | A | A | A | B | D | A | C |
| | | H/H | B | D | F | A | A | A | A | C | E | A | E |
| Cp. | S-43 | N/L | A | C | C | A | A | A | C | A | A | A | A |
| 15 | | N/N | A | E | F | A | B | A | B | A | B | A | B |
| | | H/H | A | F | F | A | B | A | A | A | C | A | C |

Ex.: Example,
Cp.: Comparative Example

As shown in Table 8, good results were obtained about Examples 20 to 24. In Comparative Examples 12 and 14, any sufficient charge-providing ability was obtainable. In particular, in Comparative Example 14, any acrylic resin was not added and hence the charge-providing ability was so low as to tend to result in a poor developing performance in the H/H environment. On the contrary, in Comparative Example 13, a good charge-providing ability to the toner was achieved, but the conductive particles were so poorly dispersible as to result in a poor developing performance in the N/L environment. In Comparative Example 15, the resin layer was made up of only acrylic resins, and hence it had so poor durability as to result in a poor developing performance after running.

EXAMPLE 25

The following materials were mixed and put to dispersion for 2 hours by means of a sand mill making use of glass beads of 1 mm in diameter as media particles, to obtain a coating material intermediate, M-2.

| | |
|---|---|
| Binder resin R-1 | 27.3 parts by mass as solid content |
| Conductive particles D-1 | 34.5 parts by mass |
| Conductive particles D-2 | 1.8 parts by mass |
| Methanol | 72.7 parts by mass |

Next, into the coating material intermediate M-2, 72.7 parts by mass as solid content, of the binder resin R-1, 8.2 parts by mass as solid content, of the acrylic resin AC-1 and 1.8 parts by mass of surface unevenness-providing spherical particles (available from Nippon Carbon Co., Ltd.; trade name: ICB0520) were mixed. The mixture obtained was put to dispersion for 40 minutes by means of a sand mill making use of glass beads of 1.5 mm in diameter as media particles, to obtain a coating fluid. With this coating fluid, a cylindrical tube made of aluminum and having an outer diameter of 16.0 mm was coated by means of a spray gun, followed by heating for 40 minutes in a 150° C. hot-air drying oven to produce a developer carrying member, S-25. Make-up of the resin layer of the developer carrying member S-25 is shown in Table 9.

This developer carrying member S-25 was set in a cyan cartridge "EP-83" (trade name; manufactured by CANON INC.) and also the developer T-3 was filled therein. Next, this cyan cartridge was set in a cyan station of a color laser printer (trade name: LBP-2040; manufactured by CANON INC.), and dummy cartridges were set in the other stations to set up an evaluation machine.

(1) Toner Charge Quantity (Q/M) and Toner Transport Quantity (M/S) on Developer Carrying Member:

The above laser beam printer was left for 24 hours in a low-temperature and low-humidity environment (15° C., 10% RH; L/L) in the state it was disconnected. Thereafter, the printer was switched on, and solid black images were reproduced. The toner carried on the developer carrying member at this point was collected by suction through a metal cylindrical tube and a cylindrical filter, where toner charge quantity per unit mass Q/M (mC/kg) and toner transport quantity per unit area M/S (g/m$^2$) were calculated from the charge quantity Q accumulated in a capacitor through the metal cylindrical tube, the mass M of the toner collected and the area S over which the toner was sucked. The values found are taken as "Q/M(1)" and "M/S(1)", respectively.

Next, in the L/L environment, horizontal line images of 2% in print percentage were reproduced on 15,000 sheets in an intermittent mode of one sheet per 10 seconds, and subsequently solid black images were reproduced. About the toner carried on the developer carrying member at this point, the Q/M and the M/S were calculated in the same way as the above. The values found are taken as "Q/M(2)" and "M/S(2)", respectively. Further thereafter, the laser beam printer was left for 5 days in the L/L environment in the state it was disconnected. Then the printer was again switched on, and solid black images were reproduced. The Q/M and M/S of the toner carried on the developer carrying member at this point were calculated in the same way as the above. The values found are taken as "Q/M(3)" and "M/S(3)", respectively.

A series of the above evaluation was also made in a normal-temperature and normal-humidity environment (23° C., 50% RH; N/N) and in a high-temperature and high-humidity environment (32° C., 85% RH; H/H). "Q/M(1)" "Q/M(2)" and "Q/M(3)" in each environment and the rates of change (1) and (2) in "Q/M(2)" and "Q/M(3)" with respect to "Q/M(1)" are shown in Table 10. Similarly, "M/S(1)" "M/S(2)" and "M/S (3)" and the rates of change in "M/S(2)" and "M/S(3)" with respect to "M/S(1)" are shown in Table 10.

(2) Image Density:

In the image reproduction test, solid images were reproduced at the initial stage, at the time of the finishing of running evaluation and, in order to evaluate a rise in triboelectric charging, 5 days after the finishing of running evaluation, and their image densities were measured to make evaluation. The image densities were measured with "Macbeth Reflection Densitometer RD918", manufactured by Macbeth Co.), where relative density with respect to the images on a white background portion of 0.00 in print density was measured.

A: 1.40 or more.

B: 1.35 or more to less than 1.40.

C: 1.30 or more to less than 1.35.

D: 1.25 or more to less than 1.30.

E: 1.00 or more to less than 1.25.

F: Less than 1.00.

(3) Halftone (HT) Uniformity:

Misty tone non-uniformity that may occur in halftone images, which tends to occur because of any non-uniform charge quantity distribution of the toner or any excess charging of the toner, was visually observed to make evaluation by the following criteria.

A: Any tone non-uniformity is not seen at all both on images and on the sleeve.

B: A slight difference in density is ascertainable on halftone images, but is little ascertainable at a glance.

C: A difference in density is ascertainable on halftone images, but at a level of no problem on solid black images.

D: A band perceivable of a difference in density is ascertainable on halftone images, but only a slight difference in density is seen on solid black images.

E: A difference in density which is clearly measurable with reflection densitometer appears on halftone images, and a difference in density is visually seen also on solid black images.

(4) Fog:

The reflectance of solid white images in proper images was measured and further the reflectance of a virgin transfer sheet was measured to make evaluation on fog, which tends to occur because of any excess charging or non-uniform charging of the toner. The value of (worst value of reflectance of solid white image)−(average value of reflectance of virgin transfer sheet) was found as fog density. The results of valuation are shown by the following criteria. Here, the reflectance was measured at 10 spots picked at random. The reflectance was measured with TC-6DS (manufactured by Tokyo Denshoku Co., Ltd.).

A: Less than 0.5%.

B: 0.5% or more to less than 1.0%.

C: 1.0% or more to less than 2.0%.

D: 2.0% or more to less than 3.0%.

E: 3.0% or more to less than 4.0%.

F: 4.0% or more.

(5) Image Quality:

The evaluation of image quality was made as evaluation on spots around minute fine-line images, concerned with the image quality of graphical images. Line reproducibility and toner spots around lines in the printing of one-dot line images, which more tends to cause spots around line images than when character lines cause spots around line images, were evaluated under magnification of images by 30 times with use of a magnifier.

A: Spots around line images little occur, showing a good line reproducibility.

B: Slight spots around line images are seen.

C: Spots around line images are seen, but not much affect line reproducibility.

D: Conspicuous spots around line images are seen, showing a poor line reproducibility.

EXAMPLES 26 TO 28 & COMPARATIVE EXAMPLES 16 TO 18

Developer carrying members S-26 to S-28 and S-44 and S-46 were produced in the same way as in Example 25 but under formulation shown in Table 9, and were evaluated in the same way. The results of evaluation are shown in Table 10.

TABLE 9

| | Developer | Acrylic resin | | Binder resin | | Conductive particles | | Conductive particles | | Uneven particles | | Volume |
|---|---|---|---|---|---|---|---|---|---|---|---|---|
| | carrying member | Type | Amt. (pbm) | Type | Amt. (pbm) | Type | Amt. (pbm) | Type | Amt. (pbm) | Amt. (pbm) | Ra μm | resistivity Ω · cm |
| Example: | | | | | | | | | | | | |
| 25 | S-25 | AC-1 | 7.3 | R-1 | 100 | D-1 | 34.5 | D-2 | 1.8 | 1.8 | 0.56 | 12.4 |
| 26 | S-26 | AC-4 | 16.7 | R-1 | 100 | D-1 | 31.7 | D-2 | 1.7 | 1.7 | 0.54 | 89.5 |
| 27 | S-27 | AC-4 | 7.4 | R-1 | 100 | D-1 | 27.1 | D-2 | 1.4 | 1.4 | 0.59 | 122 |
| 28 | S-28 | AC-9 | 7.3 | R-1 | 100 | D-1 | 34.5 | D-2 | 1.8 | 1.8 | 0.55 | 14.2 |
| Comparative Example: | | | | | | | | | | | | |
| 16 | S-44 | AC-17 | 7.3 | R-1 | 100 | D-1 | 34.5 | D-2 | 1.8 | 1.8 | 0.54 | 14.1 |
| 17 | S-45 | AC-20 | 7.4 | R-1 | 100 | D-1 | 27.1 | D-2 | 1.4 | 1.4 | 0.58 | 128 |
| 18 | S-46 | None | 0 | R-1 | 100 | D-1 | 32.2 | D-2 | 1.7 | 1.7 | 0.56 | 13.9 |

TABLE 10

15k sh.: 15,000 sheets

| | Developer carrying member | Environment | Q/M (1) | Q/M (2) | Q/M Rate of chg. (1) | Q/M (3) | Q/M Rate of chg. (2) | M/S (1) | M/S (2) | M/S Rate of chg. (1) | M/S (3) | M/S Rate of chg. (2) |
|---|---|---|---|---|---|---|---|---|---|---|---|---|
| Ex. 25 | S-25 | L/L | −26.56 | −24.94 | 6.1% | −24.79 | 6.7% | 6.5 | 5.5 | 15.4% | 5.3 | 18.5% |
| | | N/N | −23.21 | −21.88 | 5.7% | −21.80 | 6.1% | 6.3 | 5.3 | 15.9% | 5.2 | 17.5% |
| | | H/H | −20.45 | −19.01 | 7.0% | −18.88 | 7.7% | 5.9 | 5.1 | 13.6% | 5.0 | 15.3% |

TABLE 10-continued 15k sh.: 15,000 sheets

| | | | | | | | | | | | | |
|---|---|---|---|---|---|---|---|---|---|---|---|---|
| Ex. 26 | S-26 | L/L | −25.58 | −22.78 | 10.9% | −23.39 | 8.6% | 6.4 | 5.6 | 12.5% | 5.3 | 17.2% |
| | | N/N | −23.01 | −21.62 | 6.0% | −21.59 | 6.2% | 6.2 | 5.3 | 14.5% | 5.1 | 17.7% |
| | | H/H | −20.11 | −18.84 | 6.3% | −18.20 | 9.5% | 5.9 | 5.1 | 13.6% | 5.0 | 15.3% |
| Ex. 27 | S-27 | L/L | −25.49 | −21.75 | 14.7% | −23.57 | 7.5% | 6.5 | 5.5 | 15.4% | 5.4 | 16.9% |
| | | N/N | −22.99 | −21.18 | 7.9% | −21.45 | 6.7% | 6.2 | 5.2 | 16.1% | 5.0 | 19.4% |
| | | H/H | −20.32 | −18.96 | 6.7% | −18.49 | 9.0% | 5.9 | 5.1 | 13.6% | 5.0 | 15.3% |
| Ex. 28 | S-28 | L/L | −26.34 | −24.94 | 5.3% | −24.23 | 8.0% | 6.6 | 5.5 | 16.7% | 5.3 | 19.7% |
| | | N/N | −23.10 | −21.75 | 5.8% | −21.11 | 8.6% | 6.2 | 5.4 | 12.9% | 5.1 | 17.7% |
| | | H/H | −20.45 | −18.81 | 8.0% | −18.53 | 9.4% | 6.0 | 5.2 | 13.3% | 5.0 | 16.7% |
| Cp. 16 | S-44 | L/L | −25.77 | −19.97 | 22.5% | −21.45 | 16.8% | 6.4 | 4.9 | 23.4% | 5.1 | 20.3% |
| | | N/N | −23.12 | −19.85 | 14.1% | −20.21 | 12.6% | 6.2 | 5.2 | 16.1% | 5.2 | 16.1% |
| | | H/H | −20.01 | −17.96 | 10.2% | −15.92 | 20.4% | 5.9 | 5.2 | 11.9% | 4.8 | 18.6% |
| Cp. 17 | S-45 | L/L | −25.14 | −19.84 | 21.1% | −20.16 | 19.8% | 6.3 | 5.1 | 19.0% | 5.1 | 19.0% |
| | | N/N | −22.87 | −19.43 | 15.0% | −19.21 | 16.0% | 6.2 | 5.2 | 16.1% | 5.2 | 16.1% |
| | | H/H | −19.96 | −16.12 | 19.2% | −15.84 | 20.6% | 5.9 | 5.1 | 13.6% | 4.6 | 22.0% |
| Cp. 18 | S-46 | L/L | −22.01 | −17.64 | 19.9% | −17.12 | 22.2% | 6.4 | 5.1 | 20.3% | 5.0 | 21.9% |
| | | N/N | −20.01 | −16.11 | 19.5% | −15.78 | 21.1% | 6.2 | 5.0 | 19.4% | 4.7 | 24.2% |
| | | H/H | −17.62 | −13.56 | 23.0% | −11.12 | 36.9% | 5.8 | 4.7 | 19.0% | 4.0 | 31.0% |

| | Developer carrying member | Environment | Image density | | | HT uniformity | | Fog | | Image quality | |
|---|---|---|---|---|---|---|---|---|---|---|---|
| | | | Initial | 15k sh. | 5 days after | Initial | 15k sh. | Initial | 15k sh. | Initial | 15k sh. |
| Ex. 25 | S-25 | L/L | A | A | A | A | A | A | A | A | A |
| | | N/N | A | A | A | A | A | A | A | A | A |
| | | H/H | A | A | A | A | A | A | A | A | A |
| Ex. 26 | S-26 | L/L | A | A | A | B | B | A | B | A | A |
| | | N/N | A | A | A | B | B | A | B | A | A |
| | | H/H | A | A | A | A | A | A | B | A | A |
| Ex. 27 | S-27 | L/L | A | A | A | B | B | A | B | A | A |
| | | N/N | A | A | A | A | B | A | B | A | B |
| | | H/H | A | B | B | A | B | B | B | B | B |
| Ex. 28 | S-28 | L/L | A | A | A | B | B | A | B | A | B |
| | | N/N | A | A | A | A | B | A | B | A | A |
| | | H/H | A | A | A | A | B | A | A | A | B |
| Cp. 16 | S-44 | L/L | A | C | A | B | D | A | D | A | C |
| | | N/N | A | B | B | A | B | A | B | A | A |
| | | H/H | A | B | B | A | B | A | B | A | B |
| Cp. 17 | S-45 | L/L | A | A | A | C | E | B | D | A | B |
| | | N/N | A | B | B | A | C | B | D | A | C |
| | | H/H | A | C | C | A | A | B | D | B | E |
| Cp. 18 | S-46 | L/L | A | A | A | A | C | B | C | A | B |
| | | N/N | A | B | C | A | C | B | D | A | C |
| | | H/H | A | C | E | A | C | B | E | B | E |

Ex.: Example,
Cp.: Comparative Example

Good results were obtained about Examples 25 to 28. In Comparative Examples 17 and 18, any sufficient charge-providing ability was obtainable. In particular, in Comparative Example 18, any acrylic resin was not added and hence the charge-providing ability was so low as to tend to result in a poor developing performance in the H/H environment. On the contrary, in Comparative Example 16, a good charge-providing ability to the toner was achieved, but the conductive particles were so poorly dispersible as to result in a poor developing performance in the L/L environment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2008-327784, filed on Dec. 24, 2008, which is herein incorporated by reference as part of this application.

What is claimed is:

1. A developer carrying member comprising a substrate and a resin layer as a surface layer, wherein said resin layer comprises a thermosetting resin as a binder resin, an acrylic resin having units represented by the following formulas (1) and (2), and a conductive particle:

(1)

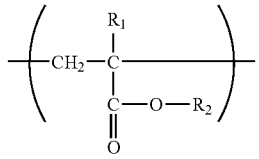

wherein $R_1$ represents a hydrogen atom or a methyl group, and $R_2$ represents an alkyl group having 8 to 18 carbon atoms; and (2)

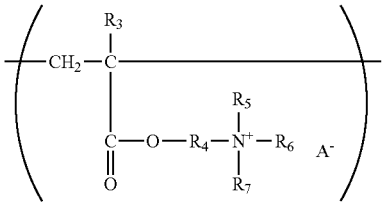

wherein $R_3$ represents a hydrogen atom or a methyl group; $R_4$ represents an alkylene group having 1 to 4 carbon atoms; one, two or three groups selected from the group consisting of $R_5$, $R_6$ and $R_7$ represents or respectively represent an alkyl group having 4 to 18 carbon atoms and the other group or groups represents or respectively represent an alkyl group having 1 to 3 carbon atoms; and $A^-$ represents an anion.

2. The developer carrying member according to claim 1, wherein, where the number of the unit (1) contained in the acrylic resin is represented by a and the number of the unit (2) contained in the acrylic resin is represented by b, the value of b/(a+b) is 0.5 or more to 0.9 or less.

3. The developer carrying member according to claim 1, wherein the acrylic resin is added in an amount of from 1 part by mass or more to 40 parts by mass or less, based on 100 parts by mass of the thermosetting resin.

4. The developer carrying member according to claim 1, wherein the thermosetting resin is a phenol resin.

5. A developing apparatus comprising a developer having a toner particle contained in a developer container, and the developer carrying member according to claim 1.

* * * * *